US006524780B2

(12) United States Patent
Yoshida et al.

(10) Patent No.: US 6,524,780 B2
(45) Date of Patent: Feb. 25, 2003

(54) GRANULATED SOLID PROCESSING AGENT FOR SILVER HALIDE PHOTOGRAPHIC MATERIAL AND PRODUCING METHOD OF THE SAME

(75) Inventors: Kazuaki Yoshida, Kanagawa (JP); Hiroki Ide, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 22 days.

(21) Appl. No.: 09/748,211

(22) Filed: Dec. 27, 2000

(65) Prior Publication Data

US 2001/0044081 A1 Nov. 22, 2001

(30) Foreign Application Priority Data

Dec. 27, 1999 (JP) ..... 11-370354
Dec. 27, 1999 (JP) ..... 11-371043

(51) Int. Cl.[7] ..... G03C 5/30; G03C 7/413
(52) U.S. Cl. ..... 430/465; 430/458

(58) Field of Search ..... 430/465, 458

(56) References Cited

U.S. PATENT DOCUMENTS 2,196,901 A * 4/1940 Ham ..... 430/465
5,258,268 A * 11/1993 Reuter et al. ..... 430/465
5,627,005 A * 5/1997 Green et al. ..... 430/465
5,663,039 A * 9/1997 Ueda et al. ..... 430/465

FOREIGN PATENT DOCUMENTS

EP A1-0-542-283 5/1993
JP A-5-93991 4/1993

* cited by examiner

*Primary Examiner*—Hoa Van Le
(74) *Attorney, Agent, or Firm*—Sughrue Mion, PLLC

(57) ABSTRACT

A granulated solid processing agent for a silver halide photographic material which is a core/shell type spherical granule comprising an internal nucleus and layer structure of one or more layers coating the internal nucleus, and the critical relative humidity of the internal nucleus is 70% or less.

7 Claims, No Drawings

GRANULATED SOLID PROCESSING AGENT FOR SILVER HALIDE PHOTOGRAPHIC MATERIAL AND PRODUCING METHOD OF THE SAME

FIELD OF THE INVENTION

The present invention relates to a photographic development processing agent (hereinafter referred to as merely "a processing agent") for a silver halide photographic material (hereinafter sometimes referred to as merely "photographic material"), and specifically relates to a granulated solid processing agent and a producing method of the same.

BACKGROUND OF THE INVENTION

For expediting DP for general customers or for rationalizing collection and delivery work between photo processing shops and processing laboratories, a small scale automatic processor called a mini-lab which is installed at photo processing shops for performing photographic processing has increasingly prevailed in these years. Concentrated liquid processing agents were supplied to mini-labs but there were a variety of problems because the processing agents were liquids, such as the regulations on transportation, the risks of the breakage of containers due to a shock, the inconveniences in handling at processing shops, and the restrictions on storing spaces. For solving these problems, processing techniques of directly adding processing agents to processing tanks are proposed, e.g., a granulated processing agent is disclosed in U.S. Pat. No. 4,923, 786, a tablet type processing agent in JP-A-5-127322 (the term "JP-A" as used herein means an "unexamined published Japanese patent application"), and a solid processing agent in U.S. Pat. No. 5,334,492.

Although a processing agent can be supplied as a solid in accordance with these methods, new problems have been arisen such that a processing agent absorbs moisture when stored for a long period of time and the stability of the agent is impaired, further, the processing agent adheres to each other and solidifies. In particular, when a processing agent contains highly hygroscopic alkali metal hydroxide and thiosulfate, if the above methods of directly adding a solid processing agent to a processing tank is used, since a solid processing agent is placed in a highly humidity condition in a processor until it is added to a processing tank, solidification occurs and hinders development processing operations, which at the same time adversely affect the finished quality of photographs.

For preventing a solid processing from solidifying with the lapse of time, a method of uniformly mixing a composition containing alkyl-substituted hydroxylamine and alkali metal hydroxide is disclosed in JP-A-6-123947, and a granule and a tablet having layer structure of two or more layers are disclosed JP-A-5-93991 and JP-A-5-134362. However, the effect of preventing solidification is not sufficient under a highly humid condition, and none of these methods can solve the above problem.

SUMMARY OF THE INVENTION

Accordingly, a first object of the present invention is to provide a granulated solid processing agent which is excellent in storage stability and compact, and a producing method of the same. A second object is to provide a granulated solid processing agent in which hygroscopicity of the hygroscopic constitutional components, in particular, alkali metal hydroxide and thiosulfate, is reduced, solidification of granules by adhering to each other is prevented, and the storage stability of which in a highly humid environment is conspicuously improved, and a producing method of the same. A third object is to provide a granulated solid processing agent which can be stably used in a processing method of directly adding a granulated solid processing agents to the processing tank of a processor.

These objects of the present invention have been accomplished by the following means:

(1) A granulated solid processing agent for a silver halide photographic material, wherein the granule is a core/shell type spherical granule comprising an internal nucleus and layer structure of one or more layers coating the internal nucleus, and the critical relative humidity of the internal nucleus is 70% or less.

(2) The granulated solid processing agent for a silver halide photographic material as described in the above item (1), wherein the critical relative humidity of the coating layer is higher than the critical relative humidity of the internal nucleus.

(3) The granulated solid processing agent for a silver halide photographic material as described in the above item (1), wherein the internal nuclei of the granules have an average particle diameter of from 0.5 to 5.0 mm.

(4) The granulated solid processing agent for a silver halide photographic material as described in the above item (1), (2) or (3), wherein the granules have an average particle diameter of from 1 to 20 mm.

(5) The granulated solid processing agent for a silver halide photographic material as described in any one of the above items (1) to (4), wherein the granules having a particle diameter of 0.5 mm or less account for 10 mass % or less based on the entire mass of the granulated solid processing agent.

(6) The granulated solid processing agent for a silver halide photographic material as described in any one of the above items (1) to (5), wherein the granule comprises an internal nucleus and layer structure of two or more layers coating the internal nucleus.

(7) The granulated solid processing agent for a silver halide photographic material as described in any one of the above items (1) to (6), wherein the internal nucleus constituting the granule contains alkali metal hydroxide.

(8) The granulated solid processing agent for a silver halide photographic material as described in the above item (7), wherein the alkali metal hydroxide is lithium hydroxide.

(9) The granulated solid processing agent for a silver halide photographic material as described in any one of the above items (1) to (6), wherein the internal nucleus constituting the granule contains thiosulfate.

(10) The granulated solid processing agent for a silver halide photographic material as described in any one of the above items (1) to (9), wherein the surface of the outermost layer of the granule is coated with a water-soluble polymer.

(11) A method for producing a granulated solid processing agent for a silver halide photographic material, wherein the granule is a core/shell type spherical granule comprising an internal nucleus and layer structure of one or more layers coating the internal nucleus, the method comprising the steps of granulating the internal nucleus having critical relative humidity of 70% or less, and then forming a coating layer on the surface of the internal nucleus.

(12) A granulated solid processing agent for a silver halide photographic material, wherein the granule is a core/shell type spherical granule comprising an internal nucleus and multi-layer structure of three or more layers coating said internal nucleus.

(13) The granulated solidprocessing agent for a silver halide photographic material as described in the above item (12), wherein the internal nucleus is composed of four or less compounds.

(14) The granulated solid processing agent for a silver halide photographic material as described in the above item (12) or (13), wherein the internal nucleus contains alkali metal hydroxide.

(15) The granulated solid processing agent for a silver halide photographic material as described in the above item (14), wherein the alkali metal hydroxide is lithium hydroxide.

(16) The granulated solidprocessing agent for a silver halide photographic material as described in the above item (12) or (13), wherein the internal nucleus contains thiosulfate.

(17) The granulated solid processing agent for a silver halide photographic material as described in any one of the above items (12) to (16), wherein the internal nuclei have an average particle diameter of from 0.5 to 5.0 mm.

(18) The granulated solid processing agent for a silver halide photographic material as described in any one of the above items (12) to (17), wherein the granules have an average particle diameter of from 1 to 20 mm.

(19) The granulated solid processing agent for a silver halide photographic material as claimed in any one of the above items (12) to (18), wherein granules having a particle diameter of 0.5 mm or less account for 10 mass % or less based on the entire mass of the granulated solid processing agent.

(20) The granulated solid processing agent for a silver halide photographic material as claimed in any one of the above items (12) to (19), wherein the surface of the outermost layer of the granule is coated with a water-soluble polymer.

(21) A method for producing a granulated solid processing agent for a silver halide photographic material, wherein the granule is a core/shell type spherical granule comprising an internal nucleus and multi-layer structure of three or more layers coating the internal nucleus, the method comprising the steps of granulating the internal nucleus, and then forming the coating layers in sequence on the surface of the internal nucleus.

The present invention is based on the fact that by taking the form of a granule having the composite structure comprising an internal nucleus of a hygroscopic component and coating layers of other components coating the internal nucleus, moisture absorption and solidification of the processing agent can be prevented under general environment of storage and handling even if the processing agent comprises hygroscopic composition. That is, a composition having critical relative humidity (the relative humidity of the air of the environment in equilibrium condition with the composition, i.e., the lowest relative humidity of the environment in which the composition absorbs moisture) of 70% or less is in general liable to absorb moisture and solidify under general environment, in particular, under the environment of a developing room. However, even with a composition whose critical relative humidity is 70% or less, moisture absorption and solidification of the processing agent do not occur under the general environment of handling and storage if the surface thereof is coated with other constitutional components. Therefore, moisture absorption and deliquescence of the alkali metal hydroxide and thiosulfate in the processing agent can be prevented. The present invention has been accomplished on the basis of the above newly found knowledge.

Further, when a hygroscopic substance is mixed with other substance, the critical relative humidity of the mixed substance generally lowers and becomes more hygroscopic. However, the present inventors have found that when the surface of a granule of composite structure is coated with other components of the processing agent in strata, even if the critical relative humidity of the internal nucleus is 70% or less and the internal nucleus comprises mixed compositions of hygroscopic component such as alkali metal hydroxide and other constitutional components, moisture absorption and solidification under the general environment of storage and handling can be prevented. Accordingly, the absorption of moisture and deliquescence by a hygroscopic component, in particular, alkali metal hydroxide and thiosulfate, can be prevented, solidification of granules with each other in a highly humid condition with the lapse of time can be prevented, and the storage stability of a granulated processing agent can be markedly improved, which has led to the present invention.

The present invention has been achieved on the basis of the fact that even if a processing agent comprises hygroscopic components, the moisture absorption of the hygroscopic components under the general environment of storage and handling and the deterioration of the processing agent resulting therefrom can be prevented by the composite structure of the granule comprising the internal nucleus of the hygroscopic components and three or more coating layers of other components laminated on the internal nucleus. Thatis, many photographic processing agents containing hygroscopic components absorb moisture under general storage environment and under the environment of a developing room, as a result, the reactive components are deteriorated, but the present inventors have found that the deterioration of the components does not occur under the general environment of storage and handling by coating the surface of the hygroscopic internal nucleus with other components even if a processing agent comprises hygroscopic components, hence moisture absorption and deliquescence of the alkali metal hydroxide and thiosulfate in the processing agent can be prevented, further, the moisture absorption-preventing effect is conspicuously improved unexpectedly by making the coating layers three or more, thus the present invention has been achieved. If moisture absorption can be prevented, the oxidation decomposition of a developing agent and hydroxylamine and derivatives thereof, thiosulfate and sulfite by moisture absorption can also be prevented and the storage stability is improved from the aspect of the composition.

Further, when a hygroscopic substance is mixed with other substance, the critical relative humidity of the mixed substance generally lowers and becomes more hygroscopic. However, the present inventors have found that when the surface of a granule of composite structure is coated with lamination of three or more layers of other components of the processing agent, even if the internal nucleus comprises mixed compositions of hygroscopic component such as alkali metal hydroxide and thiosulfate and other constitutional components, moisture absorption and the deterioration of the components resulting therefrom under the general environment of storage and handling can be prevented. Accordingly, the absorption of moisture and deliquescence by a hygroscopic component, in particular, alkali metal hydroxide and thiosulfate, can be prevented, and the storage stability of a granulated processing agent with the lapse of time in a highly humid condition can be markedly improved, which has led to the present invention.

DETAILED DESCRIPTION OF THE INVENTION

The specific modes of the present invention will be described in detail below.

The granulated solid processing agent according to the present invention has core/shell structure. When the shell comprises one or two layers, in particular, the critical relative humidity of the internal nucleus, i.e., the core, is 70% or less, and the core contains components having low critical relative humidity and high hygroscopicity. As the components having critical relative humidity of 70% or less, alkali metal hydroxide, thiosulfate, potassium carbonate, hydroxylamine sulfate, and ammonium salt such as ammonium sulfite can be exemplified.

When the internal nucleus having critical relative humidity of 60% or less is used in the present invention, the object of the present invention can be more effectively achieved. The internal nucleus having critical relative humidity of 5% or more is used practically.

In the present invention, when the internal nucleus contains alkali metal hydroxide, the effect of the present invention is conspicuous in the case where the alkali metal hydroxide is lithium hydroxide.

In the present invention, when the internal nucleus contains thiosulfate, the thiosulfate is preferably ammonium thiosulfate or sodium thiosulfate, and the effect of the present invention is conspicuous when ammonium thiosulfate is used.

In the present invention, it is preferred for the internal nucleus to contain components having critical relative humidity of 70% or less in an amount of 50 mass % or more, and the effect of the present invention is particularly conspicuous when the content is from 60 to 100 mass %. When the alkali metal hydroxide contains crystal water, the crystal water is also contained in the mass of the alkali metal hydroxide.

In the present invention, the internal nucleus contains the above-described highly hygroscopic components, but it is preferred not to mix these components with other components having low hygroscopicity. When hygroscopic components are mixed with other components, the critical relative humidity of the mixed composition becomes lower than that of the hygroscopic components alone and becomes more hygroscopic. The internal nucleus is preferably comprised of four or less components, more preferably three or more, still more preferably two or more, and most preferably a simple component.

The particle structure of the granule comprising an internal nucleus and a layer coating the internal nucleus is generally called core/shell structure, and the shell layer may comprise a multi-layer of a plurality of layers. In this case, the constitutional components can be constituted by parcelling into more stable groups.

In the present invention, the surface of the internal nucleus of the granule is coated with one or more coating layers, preferably from two to ten layers, and more preferably from two to five layers. In particular, when the shell layer comprises three or more layers, the hygroscopic property of the granule is restrained and the storage stability is markedly improved, hence very preferred. The composition of the coating layer is composed of the later-described constitutional components of the processing agent, and it is particularly preferred to be composed of the constitutional components of the processing agent exclusive of alkali metal hydroxide and thiosulfate. Further, in view of binding property, stability, mechanical strength, etc., development inactive substances such as inorganic salts and water-soluble polymers can be contained in addition to the constitutional components of the processing agent.

In the present invention, it is preferred that the critical relative humidity of the coating layer, i.e., the shell, is higher than the critical relative humidity of the internal nucleus. The critical relative humidity of the coating layer is more preferably 70% or more.

In the present invention, the total mass of the coating layer is preferably 0.5 time or more of the mass of the internal nucleus, more preferably 0.8 time or more, and particularly preferably 1.0 time or more.

The components of the processing agent constituting the granule are parcelled into the internal nucleus component, i.e., the core component, and the coating layer component, i.e., the shell component, in accordance with well-known chemical knowledge. The constitutional components are parcelled into (1) hygroscopic compounds alone, or mixed compositions of hygroscopic compounds and a small amount of other components mixable with the hygroscopic compounds, and (2) composition groups comprising one or a plurality of other components which may be mixed with each other, and the internal nucleus of the single component or the composition group (1) is coated with one or more layers of the single component or the mixed composition group (2). Granules are manufactured by optimizing the parcelling method in accordance with the design guide of granules having composite structure.

In the present invention, a spherical granule means a particle obtained by granulating powder spherically. "Spherical" may be or may not be perfectly spherical, and granular shapes generally called pellets, pills and beads are included.

In the present invention, the average particle diameter of the granules is preferably from 0.5 to 20 mm, more preferably from 1 to 15 mm, and very preferably from 2 to 10 mm. When the granules having an average particle diameter of 0.5 mm or less account for 10 mass % or less of the granular type solid processing agent, the effect of the present invention is conspicuous, and particularly preferably from 0 to 5 mass %.

In the present invention, the shape of the internal nucleus can be granulated variously, e.g., spherical, cylindrical, prismatic, and undefined shapes. In view of the easiness of coating multi-components on the internal nucleus, a spherical shape is preferred and from the easiness of manufacturing the internal nucleus, an undefined shape is preferred. In the present invention, the average particle diameter of the internal nucleus is preferably from 0.1 to 5 mm, more preferably from 0.2 to 4 mm, and very preferably from 0.3 to 3 mm. Further, the average thickness of each coating layer is generally from 0.01 to 5 mm, preferably from 0.05 to 2.5 mm, and more preferably from 0.1 to 1.5 mm. It has been known that the number of coating layers, such as three layers or more, is more contributable to the reduction of hygroscopicity and the improvement of storage stability of the granules than the thickness of the coating layer.

In the present invention, granulation of the internal nucleus and coating of layers on the internal nucleus can be performed by various well-known granulation methods.

These various granulation methods applicable to the present invention are described in Nihon Funtai Kogyo Gijutsu Kyokai compiled, *Zoryu Handbook* (*Granulation Handbook*) (1991), and JP-A-4-221951 and JP-A-2-109043. Of these methods, representative granulation methods are enumerated below as preferred methods but the present invention is not limited thereto.

(1) Rolling granulation method (*Zoryu Handbook*, p. 133)

A granulation method comprising the steps of spraying a liquid (binder) with rolling the raw material powder in a rotating container such as a rotating drum or a rotating dish and agglomerating the powder as a snowball with the surface energy as the motive power.

(2) Compression granulation method (*Zoryu Handbook*, p. 199)

A method called briquetting which comprises the step of forming briquettes by compressing the raw material powder between rotating two rolls to form pockets of briquettes on the surface of the rolls, and a method called compacting which comprises the steps of forming surface-smooth flakes of the raw material powder and then crushing these flakes.

(3) Stirring granulation method (*Zoryu Handbook*, p. 379)

An agglomeration granulation method of forcibly giving flowing motion to the raw material powder by means of the stirring blades installed in the container with spraying a liquid.

(4) Extrusion granulation method (*Zoryu Handbook*, p. 169)

A granulation method of extruding the raw material powder from a die and the minute pores of a screen. As the extruder, screw type, roll type, blade type, self-forming type and ram type extruders are used.

(5) Crushing granulation method (*Zoryu Handbook*, p. 349)

There are a dry method and a wet method. A dry method is a method of obtaining granules by crushing the briquettes and compact flakes obtained in the above-described compression granulation method. A wet method is a method of humidifying the powder in advance and granulating by crushing the kneaded product. In either method, compression, crushing and fractionation are performed by shocking with a hammer, shearing with a cutter, etc., and by an irregular tooth roll and a corrugated roll.

(6) Fluidized bed granulation method (*Zoryu Handbook*, p. 283)

A granulation method of spraying a binder with maintaining the powder in a state of floating and suspending in a fluid blowing upward. This operation belongs to unit operation called fluidization, and a fluidized bed multi-functional type granulating machine combining fluidization with rolling and stirring can be used in this granulation method.

(7) Coating granulation method (*Zoryu Handbook*, p. 409)

A granulation method of coating the carrying particles on the surface of a nucleus sprayed with a coating material and a binder solution. There are kinds of pan coating which rolls by a rotating drum, rolling coating which rolls by a rotating disc, fluidized bed coating which forms a fluidized bed by air flow, and centrifugal flowing type coating which causes planetary motion by centrifugal force by the rotation of a rotor and slit air.

(8) Melting granulation method (*Zoryu Handbook*, p. 227)

A granulation method of fractionating or flaking a molten material by ejection or dripping on a plate, and then cooling and solidifying.

(9) Spray drying granulation method (*Zoryu Handbook*, p. 249)

A granulation method of spraying and atomizing a solution, a paste and a suspension in hot air current in a drying tower and at the same time evaporating the water content to make dry granules.

(10) Liquid phase granulation method (*Zoryu Handbook*, p. 439)

A capsule granulation method known as a manufacturing method of microcapsules. There are an interfacial polymerization method, a hardening coating method in liquid, an emulsion method, an inclusion exchange method and a spray drying method.

(11) Vacuum freezing granulation method (*Zoryu Handbook*, p. 469)

A method of manufacturing granules by utilizing a frozen state (cooling solidification) using a wet material which cannot maintain a particle shape at ordinary temperature.

In the present invention, the internal nucleus is preferably granulated by a compression granulation method, and a compacting method is especially preferred to exhibit the effect of the present invention. Coating on the internal nucleus is preferably performed by a rolling granulation method, a fluidized bed granulation method, or a coating granulation method, and a coating granulation method using a centrifugal flowing type coating machine is especially preferred to exhibit the effect of the present invention.

The granules according to the present invention are preferably coated with a water-soluble polymer. The water-soluble polymers to be used in coating are not particularly restricted and one or two or more selected from synthetic, semisynthetic and natural water-soluble polymer substances can be used, e.g., gelatin, pectin, polyacrylic acid, polyacrylate, polyvinyl alcohol, modified polyvinyl alcohol, polyvinyl pyrrolidone, polyvinyl pyrrolidone-vinyl acetate copolymer, polyethylene glycol, hydroxypropylmethyl cellulose, sodium carboxymethyl cellulose, hydroxyethyl cellulose, hydroxypropyl cellulose, methyl cellulose, sodium alginate, xanthane gum, gum arabic, tragacanth gum, karaya gum, and carrageenan, and it is preferred in the present invention to use one or two or more of polyethylene glycol, polyvinyl pyrrolidone, hydroxypropyl cellulose, methyl cellulose, gum arabic and carrageenan.

The coating amount of the water-soluble polymers is not particularly restricted so long as the amount is within the range of generally used coating amount, but the amount is preferably from 0.001 to 10 mass %, particularly preferably from 0.01 to 5 mass %, based on the granule.

The coating methods of the water-soluble polymers are not also particularly restricted, but it is preferred to use the above-described rolling granulation method, stirring granulation method, fluidized bed granulation method, coating granulation method, melting granulation method, or spray drying granulation method. Above all, a method of spray coating an aqueous solution of a polymer in concentration of from 1 to 50% on the surface of the granules and drying in accordance with the above rolling granulation method, fluidized bed granulation method, coating granulation method or spray granulation method is particularly preferred.

The compositions and forms of the development processing agent according to the present invention are described in detail below.

A granulated processing agent may be comprised of independent parts without mixing different granules constituting the processing agent, or may be comprised of one part by mixing a plurality of granules. "Part" used here means a partial constitutional agent which constitutes the processing agent as is generally used in the industry and defined by ISO 5989, and the processing solution is obtained by dissolving each part in one container.

The containers of the granulated processing agent for use in the present invention are bags and bottles, and the materials of the containers may be any of paper, plastics, metals and the like. From the viewpoint of the environmental protection, bag and bottle-like containers made of paper and plastic films are preferred. From the viewpoint of various stabilities, package materials having a barrier property are preferred. Plastic materials having an oxygen permeation coefficient of 200 ml/$m^2$ 24 hours-pascal or less are particularly preferred. Further, an oxygen permeation coefficient can be measured in accordance with the method described in *$O_2$ Permeation of Plastic Container, Modern Packing*, pp. 143 to 145, N.J., Calyan (December, 1968). Specific examples of preferred plastic materials include vinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA), and polyethylene terephthalate (PET). The use of PVDC, NY, PE, EVA, EVAL or PET is preferred in the present invention for the purpose of reducing oxygen permeability.

As the specific package forms of the containers of the granulated processing agent, the materials are formed into films, bags or bottles. When the processing agent is used as the solid photographic processing agent packaged with a barriering film, films having a thickness of from 10 to 150 μm are preferably used for protecting the processing agent from moisture. Composite materials using, as the barriering package materials, one or more selected from a polyolefin film, e.g., polyethylene terephthalate, polyethylene, and polypropylene, kraft paper capable of having moisture resistance with polyethylene, waxed paper, moisture resisting cellophane, glassine paper, polyester, polystyrene, polyvinyl chloride, vinylidene chloride-maleic acid copolymer, polyvinylidene chloride, polyamide, polycarbonate, acrylonitrile, metallic foil, e.g., aluminum foil, and metallized polymer film are preferably used.

Package materials of high barrier (high cutting off property) films comprising composite materials are especially preferably used in the present invention for their high cutting off property of water, gas, light, etc., fastness, flexibility and sealing property (processing property). Examples of the composite materials include, e.g., (1) polyethylene terephthalate/low density polyethylene, (2) vinylidene chloride-maleic acid copolymer-coated cellophane/low density polyethylene, (3) polyethylene terephthalate/vinylidene chloride-maleic acid copolymer/low density polyethylene, (4) nylon/low density polyethylene, (5) low density polyethylene/vinylidene chloride-maleic acid copolymer/low density polyethylene, (6) nylon/EVAL/low density polyethylene, (7) polyethylene terephthalate/EVAL/low density polyethylene, and (8) aluminum deposited polyethylene terephthalate. The high barrier package materials described in *Kinosei Hoso Zairyo no Shin Tenkai* (*Development of New Functional Package Materials*), Toray Research (February, 1990) can be used in the present invention.

In addition, the low oxygen permeable and low vapor permeable containers disclosed in JP-A-63-17453, and the vacuum package materials disclosed in JP-A-4-19655 and JP-A-4-230748 can also be used preferably in the present invention.

As one use mode, the granulated processing agent according to the present invention can be mounted on an automatic processor together with a container for development processing, and a preferred container in such a case is the container made, as a single constituting resin, of high density polyethylene (hereinafter referred to as HDPE) having a density of from 0.941 to 0.969, more preferably from 0.951 to 0.969, and still more preferably from 0.955 to 0.965, and a melt index of from 0.3 to 5.0 g/10 min, more preferably from 0.3 to 5.0 g/10 min, and still more preferably from 0.3 to 4.0 g/10 min. A melt index is a value measured in accordance with the method defined by ASTM D1238 at 190° C. with the load of 2.16 kg. This container preferably has a thickness of from 500 to 1,500 μm. However, the containers of the processing agent for use in the present invention are not limited to the above HDPE container which is convenient to be mounted on a processor, and materials other than HDPE, e.g., polyethylene terephthalate (PET), polyvinyl chloride (PVC), and low density polyethylene (IDPE), containers made of HDPE having the density and melt index out of the above range can also be used.

The structures and producing methods of the granulated processing agent according to the present invention have been mentioned hitherto. In the next place, the chemicals of constitutional components of each processing agent are described below.

The granulated processing agent according to the present invention can be applied to any of a developing solution, a bleaching solution, a fixing solution, and a blixing solution and, if necessary, a stabilizing solution, or both of the processing agents for color photographic materials and black-and-white photographic materials, or the processing agents for photographing and printing.

Further, "development" and "development processing", and "developing agent" and "development processing agent" are used in a wide meaning showing a chain of processes from development process to drying process and processing agents for a chain of processes, and in a narrow meaning showing only development process and a processing agent for only development process. When "what does it means" is unclear from the context of the sentence, the wide meaning is described as "processing" and "processing agent", and the narrow meaning is described as "development" and "development processing agent" in this specification.

The constitutional components of the color developer are described in the first place.

Preferred examples of the color developing agents are well-known aromatic primary amine color developing agents, in particular, p-phenylenediamine derivatives. Representative examples of p-phenylenediamine derivatives are shown below, but the present invention is not limited thereto.

1) N,N-Diethyl-p-phenylenediamine
2) 4-Amino-N,N-diethyl-3-methylaniline
3) 4-Amino-N-(β-hydroxyethyl)-N-methylaniline
4) 4-Amino-N-ethyl-N-(β-hydroxyethyl)aniline
5) 4-Amino-N-ethyl-N-(β-hydroxyethyl)-3-methylaniline
6) 4-Amino-N-ethyl-N-(3-hydroxypropyl)-3-methylaniline
7) 4-Amino-N-ethyl-N-(4-hydroxybutyl)-3-methylaniline
8) 4-Amino-N-ethyl-N-(β-methanesulfonamidoethyl)-3-met hylaniline
9) 4-Amino-N,N-diethyl-3-(β-hydroxy ethyl)aniline
10) 4-Amino-N-ethyl-N-(β-methoxyethyl)-3-methylaniline
11) 4-Amino-N- (β-ethoxyethyl)-N-ethyl-3-methylaniline
12) 4-Amino-N-(3-carbamoylpropyl)-N-n-propyl-3-methylaniline
13) 4-Amino-N-(4-carbamoylbutyl)-N-n-propyl-3-methylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidinecarboxamide Of the above p-phenylenediamine derivatives, preferred are Compounds 5), 6), 7), 8) and 12), and Compounds 5) and 8) are particularly preferred. When these p-phenylenediamine derivatives are in solid states, they generally take the form of salts such as sulfate, hydrochloride, sulfite, naphthalenedisulfonate, and p-toluenesulfonate.

The granulated processing agent composition is mixed with water in a prescribed ratio for use to make the working solution of a developing solution or a developing solution replenisher (hereinafter, when differentiating a developing solution from a developing solution replenisher does not have a particular meaning, both are called a developing solution collectively, and so with a developer and a developer replenisher). The concentration of an aromatic primary amine developing agent in a developing working solution is from 2 to 200 mmol, preferably from 6 to 100 mmol, and more preferably from 10 to 40 mmol, per liter of the developing working solution.

A color developer contains a small amount of sulfite ion in some case according to the objective photographic material, or does not substantially contain in another case. It is preferred for a color developer to contain a small amount of sulfite ion in the present invention. A sulfite ion in some cases adversely affects photographic characteristics during color developing process when excessively used, although it has conspicuous preservative property.

A color developer may contain a small amount of hydroxylamine. When hydroxylamine (generally used in the form of hydrochloride or sulfate but the form of a salt is omitted hereinafter) is contained, it functions as the preservative of a developing solution the same with the sulfite ion, but it sometimes affects photographic characteristics due to the silver development activity of hydroxylamine itself. Therefore, the addition amount should be limited to a small amount.

A color developer may contain organic preservatives besides the above-described hydroxylamine and sulfite ion. Organic preservatives means general organic compounds which reduce the deterioration speed of an aromatic primary amine color developing agent when added to the processing solution of a photographic material. That is, organic preservatives are organic compounds having a function to prevent the air oxidation of color developing agents and, above all, hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring amines are particularly effective organic preservatives. These organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020, and JP-B-48-30496 (the term "JP-B" as used herein means an "examined Japanese patent publication").

In addition, the various metals disclosed in JP-A-57-44148 and JP-A-57-53749, the salicylic acids disclosed in JP-A-59-180588, the alkanol amines disclosed in JP-A-54-3532, the polyethyleneimines disclosed in JP-A-56-94349, and the aromatic polyhydroxyl compounds disclosed in U.S. Pat. No. 3,746,544 may be used as preservatives, if necessary. In particular, e.g., alkanolamines such as triethanolamine and triisopropanolamine, substituted or unsubstituted dialkylhydroxylamine such as disulfoethylhydroxylamine and diethylhydroxylamine, or aromatic polyhydroxyl compounds are preferably used.

Of the above organic preservatives, details of hydroxylamine derivatives are disclosed in JP-A-1-97953, JP-A-1-186939, JP-A-1-186940, and JP-A-1-187557. The combined use of hydroxylamine derivatives with amines is sometimes effective for improving the stability of a color developing solution and the stability of continuous processing.

As examples of other amines, the cyclic amines as disclosed in JP-A-63-239447, the amines as disclosed in JP-A-63-128340, and the amines as disclosed in JP-A-1-186939 and JP-A-1-187557 can be exemplified. The content of preservatives in a processing agent differs in accordance with the kind of preservatives but they are generally added so as to reach the concentration in a working solution of from 1 to 200 mmol, preferably from 10 to 100 mmol, per liter of the developing solution.

If necessary, chloride ions may be added to a color developer, e.g., a color developer for color paper. In many cases, a color developing solution (in particular, a color developer for color print materials) contains chloride ions in an amount of from $3.5\times10^{-2}$ to $1.5\times10^{-1}$ mol/liter, but since chloride ions are released into a developing solution as the by-product of development, the addition to a developer replenisher is not necessary in many cases. A developer for photographic materials for photographing may not contain chloride ions.

With respect to bromide ions, the concentration of bromide ions in a color developing solution is preferably from 1 to $5\times10^{-3}$ mol/liter or so for processing the materials for photographing and $1.0\times10^{-3}$ mol/liter or less for processing the materials for printing. There are cases where bromide ions are not necessary to be added to a color developer as the same with the above chloride ions, but when bromide ions are added, they are added to the processing agent according to necessity so as to reach the above bromide ion concentration range.

When the materials to be processed are a color negative film and a color reversal film which are obtained from a silver iodobromide emulsion, the situation with the iodide ions is the same as the above case. In general, iodide ions are released into a developing solution in a concentration of from 0.5 to 10 mg or so per liter of a developing solution, hence iodide ions are not generally contained in the replenisher for a processing agent.

When halides are added as the components of a developer or developer replenisher, sodium chloride, potassium chloride, ammonium chloride, lithium chloride, nickel chloride, magnesium chloride, manganese chloride, and calcium chloride can be exemplified as the chloride ion-supplying substances. Sodium chloride and potassium chloride are preferred of these.

As the bromide ion-supplying substances, sodium bromide, potassium bromide, ammonium bromide, lithium bromide, calcium bromide, magnesium bromide, manganese bromide, nickel bromide, cerium bromide, and thallium bromide can be exemplified. Potassium bromide and sodium bromide are preferred of these.

As the iodide ion-supplying substances, sodium iodide and potassium iodide are used.

In the present invention, it is preferred that various additives are added so as to maintain the pH of a developing solution of from 9.0 to 13.5 and the pH of a developing solution replenisher of from 9.0 to 13.5, hence an alkali agent, a buffer and, if necessary, an acid agent can be added to the developer and the developer replenisher to maintain the pH value.

As the alkalis, various kinds of hydroxides can be added to the internal nucleus of the granulated processing agent according to the present invention, e.g., potassium hydroxide, sodium hydroxide, lithium hydroxide, tripotassium hydrogenphosphate, trisodium hydrogenphosphate and hydrates of these compounds can be exemplified. Further, triethanolamine and diethanolamine may be added by providing liquid agent part of different constitution from a granulated agent. As the acid agent to be added according to necessity, inorganic and organic water-soluble solid state acids, e.g., succinic acid, tartaric acid, propionic acid and ascorbic acid can be used.

When a processing solution is prepared, it is preferred to use various buffers to maintain the above pH range. Examples of the buffers which can be used include carbonate, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Carbonates, phosphates, tetraborates and hydroxybenzoates are particularly excellent in buffering ability in a high pH range of pH 9.0 or more, and do not adversely affect photographic properties (e.g., to cause fogging) when added to a color developing solution and inexpensive, therefore, the use of these buffers is particularly preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium5-sulfo-2-hydroxybenzoate (sodium 5-sulfosalicylate), and potassium 5-sulfo-2-hydroxybenzoate (potassium 5-sulfosalicylate). However, the present invention is not limited thereto.

Since the buffer is not a component which is reacted and consumed, the addition amount to the composition is set up so that the concentration in a developing solution and a developing solution replenisher prepared from the processing agent becomes from 0.01 to 2 mol/liter, preferably from 0.1 to 0.5 mol/liter.

Various chelating agents can be used in a color developing solution for preventing the precipitation of other developing solution components, e.g., calcium and magnesium, or improving the stability of a color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, ethylenediaminedisuccinic acid (SS body), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid.

These chelating agents may be used in combination of two or more, if required.

The addition amount of these chelating agents should be the amount sufficient to sequester metal ions in a color developing solution prepared, e.g., about 0.1 g to 10 g per liter.

The color developing solution according to the present invention can contain an arbitrary development accelerator, if desired. For example, the thioether-based compounds disclosed in JP-B-37-16088, JP-B-37-5987, JP-B-38-7826, JP-B-44-12380, JP-B-45-9019 and U.S. Pat. No. 3,813,247, the p-phenylenediamine-based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine-based compounds disclosed in U.S. Pat. Nos. 2,494,903, 3,128,182, 4,230,796, 3,253,919, JP-B-41-11431, U.S. Pat. Nos. 2,482,546, 2,596,926,and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator, if necessary. The addition amount of these compounds to the composition is set up so that the concentration in a developing solution and a developing solution replenisher prepared from the processing agent becomes from 0.001 to 0.2 mol/liter, preferably from 0.01 to 0.05 mol/liter.

Besides the foregoing halogen ions, an antifoggant can be arbitrarily added to the color developer for use in the present invention, if necessary. Representative examples of organic antifoggants include, e.g., nitrogen-containing heterocyclic compounds such as benzotriazole, 6-nitrobenz-imidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

Further, the color developer for use in the present invention can contain various surfactants, if required, e.g., alkylsulfonic acid, arylsulfonic acid, aliphatic carboxylic acid, and aromatic carboxylic acid can be used. The addition amount of these compounds to the composition is set up so that the concentration in a developing solution and a developing solution replenisher prepared from the processing agent becomes from 0.0001 to 0.2 mol/liter, preferably from 0.001 to 0.05 mol/liter.

The processing agents for color development for use in the present invention are as described above. In the next place, the constitution of black-and-white developers will be explained below.

Conventionally well-known developing agents can be used in a black-and-white developer. As the developing agents, dihydroxybenzenes (e.g., hydroquinone, hydroquinone-monosulfonate, catechol), 3-pyrazolidones (e.g., 1-phenyl-3-pyrazolidone, 1-phenyl-4-methyl-4-hydroxymethyl-3-pyrazolidone, 1-phenyl-4,4-dihydroxymethyl-3-pyrazolidone), aminophenols (e.g., N-methyl-p-aminophenol, N-methyl-3-methyl-p-aminophenol, N-methyl-2-sulfoaminoaminophenol), ascorbic acid and erythorbic acid and isomers and derivatives thereof, and the later-described p-phenylenediamines which are also used as a color developing agent can be used alone or in combination. When these developing agents are used in the form of a salt, the form of sulfate, hydrochloride, phosphate, or p-toluenesulfonate is used as the counter salt. The addition amount of these developing agents is preferably from $1\times10^{-5}$ to 2 mol/liter of the prepared developing solution.

Preservatives canbe used in a black-and-white developer, if necessary. Sulfite and bisulfite are generally used as the preservatives. They are added so that the concentration in a developing solution prepared becomes from 0.01 to 1 mol/liter, preferably from 0.1 to 0.5 mol/liter. Ascorbic acid is also an effective preservative and it is preferably added so that the concentration in a developing solution prepared becomes from 0.01 to 0.5 mol/liter. In addition, hydroxylamines, saccharides, o-hydroxyketones and hydrazines can also be used, and they are added so that the concentration in a developing solution prepared becomes from 0.002 to 1.0 mol/liter.

The pH of a black-and-white developing solution is preferably from 8 to 13 and most preferably from 9 to 12. For maintaining the pH value, various kinds of alkali agents, buffers and, if necessary, acid agents are added to a development processing agent. Preferred examples of alkali agents, buffers and acid agents are the same as those described in the item of the color developer above, and as other examples of buffers, hydroxybenzoate, glycine salts, N,N-dimethylglycine salts, leucine salts, norleucine salts, guanine salts, 3,4-dihydroxyphenylalanine salts, alanine salts, aminobutyrates, valine salts, and lysine salts can be exemplified. These buffers are used in the form of salts of alkali metals such as Na and K and ammonium salt as the counter salts. These buffers may be used alone, or two or more kinds thereof may be used in combination.

A black-and-white developer may also contain a silver halide solvent as a development accelerator. Specific examples of development accelerators for a black-and-white developer include, e.g., thiocyanate, sulfite, thiosulfate, 2-methylimidazole, various kinds of quaternary amines, polyethylene oxides, 1-phenyl-3-pyrazolidones, primary amines, N,N,N',N'-tetramethyl-p-phenylenediamine, the thioether-based compounds disclosed in JP-A-57-63580, and the development accelerators described above in the item of the color developer. These compounds are added so that the concentration in a developing solution (a developing solution replenisher) prepared becomes preferably from 0.005 to 0.5 mol/liter or so.

The granulated black-and-white developer according to the present invention may also contain various kinds of antifoggants described in the item of the color developer for the purpose of preventing development fog.

Further, the black-and-white developer according to the present invention can contain a swelling inhibitor (e.g., inorganic salt such as sodium sulfate, potassium sulfate) and a hard water softener.

If necessary, various kinds of hard water softeners and surfactants described above in the item of the color developer can be added to the black-and-white developer in the same concentration.

The development processing agents are as described above. In the next place, the processing agents for desilvering process will be described. The bleaching agents for a bleaching solution and a blixing solution in color development processing are described first.

As the bleaching agents for use in a bleaching or blixing solution, well-known bleaching agents can be used, in particular, organic complex salts of iron(III) (e.g., complex salts of aminopolycarboxylic acids), or organic acids such as citric acid, tartaric acid, and malic acid, persulfate, and hydrogen peroxide are preferably used.

Of these compounds, organic complex salts of iron(III) are particularly preferred from the viewpoint of rapid processing and environmental protection. Examples of aminopolycarboxylic acids and salts thereof useful for forming organic complex salts of iron(III) include biodegradable ethylene-diaminedisuccinic acid (SS body), N-(2-carboxylatoethyl)-L-aspartic acid, β-alaninediacetic acid, methyliminodiacetic acid, in addition, ethylenediaminetetraacetic acid, diethylenetriaminepentaacetic acid, 1,3-diamino-propanetetraacetic acid, propylenediaminetetraacetic acid, nitrilotriacetic acid, cyclohexanediaminetetraacetic acid, iminodiacetic acid, and glycol ether diaminetetraacetic acid. These compounds may take any form of sodium salt, potassium salt, lithium salt and ammonium salt. Of these compounds, ethylenediaminedisuccinic acid (SS body), N-(2-carboxylato-ethyl)-L-aspartic acid, β-alaninediacetic acid, ethylene-diaminetetraacetic acid, 1,3-diaminopropanetetraacetic acid, and methyliminodiacetic acid are preferred because iron (III) complex salts thereof are excellent in photographic characteristics. These ferric ion complex salts may be used in the form of complex salt, or ferric ion complex salts may be formed in a solution using ferric salts, e.g., ferric sulfate, ferric chloride, ferric nitrate, ferric ammonium sulfate and ferric phosphate with a chelating agent such as aminopolycarboxylic acid. A chelating agent may be used in the excess amount more than the amount for forming ferric ion complex salt. Of the iron complexes, aminopolycarboxylic acid iron complex is preferred.

The addition amount of these bleaching agents is set up so that the concentration in a processing solution prepared becomes from 0.01 to 1.0 mol/liter, preferably from 0.03 to 0.80 mol/liter, more preferably from 0.05 to 0.70 mol/liter, and still more preferably from 0.07 to 0.50 mol/liter.

It is preferred for a bleaching agent, a blixing agent or a fixing agent to contain various well-known organic acids (e.g., glycolic acid, succinic acid, maleic acid, malonic acid, citric acid, sulfosuccinic acid, etc.), organic bases (e.g., imidazole, dimethylimidazole, etc.), or 2-picolinic acid including the compound represented by formula (A-a) disclosed in JP-A-9-211819 and kojic acid including the compound represented by formula (B-b) disclosed in the same patent. The addition amount of these compounds is set up so that the concentration in a processing solution prepared becomes preferably from 0.005 to 3.0 mol/liter, more preferably from 0.05 to 1.5 mol/liter.

The fixing agents for processing color (inclusive of fixing agents in the blixing agents for color photographic processing) and black-and-white photographic materials are explained en masse. The compounds for use in these blixing and fixing agents are well-known fixing chemicals, i.e., thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and water-soluble silver halide solvents such as thioureas, and these compounds can be used alone or in combination of two or more. Further, the specific blixing solution comprising combination of a fixing agent and halides such as a great amount of potassium iodide as disclosed in JP-A-55-155354 can also be used in the present invention. Thiosulfate, in particular, ammonium thiosulfate, is particularly preferably used in the present invention. The concentration of the fixing chemicals in a fixing solution and a blixing solution prepared from the granulated processing agents is preferably from 0.3 to 3 mol, more preferably from 0.5 to 2.0 mol, per liter of the solution.

The blixing solution and fixing solution for use in the present invention preferably have pH of from 3 to 8, particularly preferably from 4 to 8. When the pH is lower than this range, the solution is deteriorated and cyan dyes become leuco dyes acceleratedly, although desilvering property is improved. While when the pH is higher than this range, desilvering is delayed and stains are liable to occur.

The bleaching solution prepared from the granulated agent according to the present invention has pH of 8 or less, preferably from 2 to 7, and particularly preferably from 2 to 6. When the pH is lower than this range, the solution is deteriorated and cyan dyes become leuco dyes acceleratedly, while when the pH is higher than this range, desilvering is delayed and stains are liable to occur.

For adjusting pH, if necessary, the above-described solid state acids and solid state alkalis, e.g., potassium hydroxide, sodium hydroxide, lithium hydroxide, lithium carbonate, sodium carbonate, potassium carbonate, and acidic or alkaline buffers can be used.

Further, the blixing solution of the present invention can contain other various kinds of brightening agents, defoaming agents, surfactants, and polyvinylpyrrolidone. Brightening agents can be added to the above-described color developer so that the concentration in a developing solution prepared becomes from 0.02 to 1.0 mol/liter.

It is preferred that the blixing solution and fixing solution of the present invention contain, as a preservative, releasing compounds of sulfite ions such as sulfite (e.g., sodium sulfite, potassium sulfite, ammonium sulfite, etc.), bisulfite (e.g., ammonium bisulfite, sodium bisulfite, potassium bisulfite, etc.), metabisulfite (e.g., potassium metabisulfite, sodium metabisulfite, ammonium metabisulfite, etc.), and arylsulfinic acids such as p-toluenesulfinic acid and m-carboxybenzenesulfinic acid. The content of these compounds is preferably from about 0.02 to about 1.0 mol/liter in terms of a sulfite ion or sulfinate ion.

In addition to the above compounds, ascorbic acid, bisulfite adducts of carbonyl and carbonyl compounds may be used as preservatives.

A photographic material is in many cases processed in a stabilizing bath substituting for a washing bath or an image stabilizing bath after fixing step or blixing step. These baths are low in concentration and the effect of granule type processing agents are not so large, but if necessary, granulated processing agents can be manufactured. The method of reducing the calcium ion and magnesium ion concentrations as disclosed in JP-A-62-288838 can be used extremely effectively in a stabilizing bath processing agent. Also, the isothiazolone compounds and the thiabendazoles as disclosed in JP-A-57-8542, the chlorine-based antibacterial agents such as chlorinated sodium isocyanurate as disclosed in JP-A-61-120145, the benzotriazole and copper ions as disclosed in JP-A-61-267761, and the antibacterial agents described in Hiroshi Horiguchi, *Bohkin Bohbai no Kagaku* (*Antibacterial and Antifungal Chemistry*), published by Sankyo Shuppan Co., Ltd. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986) can be used.

Further, aldehydes such as formaldehyde, acetaldehyde and pyruvic aldehyde which inactivate the residual couplers and prevent the discoloration of dyes, the methylol compounds and hexamethylenetetramine disclosed in U.S. Pat. No. 4,786,583, the hexahydrotriazines disclosed in JP-A-2-153348, the bisulfite adducts of formaldehyde disclosed in U.S. Pat. No. 4,921,779, and the azolylmethylamines disclosed in EP 504609 and EP 519190 may be added to the processing agent according to the present invention. A surfactant as a water draining agent and a chelating agent represented by EDTA as a hard water softener can also be used.

The constitutional components of the processing agents to which the present invention can be applied are as described above, and the processing steps in which the processing agents of the present invention are used will be described below.

The development process to which the present invention can be applied comprises a color developing step, a desilvering step, a washing or stabilizing step and a drying step when the material is a color photographic material. An auxiliary steps such as a rinsing step, an intermediate washing step, a neutral step, etc., can be provided between each step. A desilvering step is performed in one step process of a blixing step or two step process of a bleaching step and a fixing step. Besides a stabilizing bath substituting for a washing bath, an image stabilizing bath for the purpose of stabilizing images can be provided between a washing step or a stabilizing step and a drying step.

When the material is a black-and-white photographic material, the development process comprises a developing step, a fixing step, a washing step and a drying step. An auxiliary steps such as an intermediate washing step, a neutral step including a rinsing step can be provided between each step.

The processing method of the present invention may be performed according to any of a rapid developing method, a low replenishing method, and a world-wise interchangeable standard type processing method.

Color and black-and-white developing steps are immersion bath processing steps of immersing photographic materials in developing solutions, and the developing solutions are alkaline continuous phase liquids containing the constitutional components in a molten state. A developing solution and a developing solution replenisher are prepared and used in a developing tank and a replenisher tank respectively.

When the photographic materials to be development processed are the materials for general color photographing such as a color negative film or a color reversal film, the development processing temperature is in general from 30 to 40° C., but the processing temperature in rapid processing is from 38 to 65° C., and preferably from 40 to 55° C., and the development processing time in general processing is from 1 to 8 minutes, and that in rapid processing is from 15 to 195 seconds, preferably from 20 to 150 seconds. The replenishing rate in standard development is 600 ml per $m^2$ of the photographic material but that in low replenishing processing is from 30 to 390 ml, preferably from 50 to 300 ml, and in some cases from 80 to 200 ml.

When the photographic materials to be development processed are the materials for color print such as color photographic paper, the development processing temperature is in general from 30 to 40° C., but the processing temperature in rapid processing is from 38 to 65° C., and the development processing time in general processing is from 30 seconds to 3 minutes, and that in rapid processing is from 5 to 45 seconds, preferably from 5 to 20 seconds. The replenishing rate in standard development is 161 ml perm$^2$ of the photographic material but that in low replenishing processing is from 10 to 150 ml, preferably from 20 to 100 ml, and in some cases from 25 to 80 ml.

The processing temperature and the processing time of the black-and-white materials for photographing and print are the same range as in the above color development.

In color development process, a development step is followed by a desilvering step and the process is performed with a bleaching solution and a blixing solution.

The bleaching time is in general from 10 seconds to 6 minutes and 30 seconds, preferably from 10 seconds to 4 minutes and 30 seconds, and particularly preferably from 15 seconds to 2 minutes.

In the blixing process according to the present invention, the processing time is generally from 5 to 240 seconds, preferably from 10 to 60 seconds, and the processing temperature is in general from 25 to 60° C., preferably from 30 to 50° C. The replenishing rate is from 10 to 250 ml per $m^2$ of the photographic material, preferably from 10 to 100 ml, and particularly preferably from 15 to 60 ml.

In black-and-white development process, a development step is followed by a fixing step. In the fixing step, the processing time is from 5 to 240 seconds, preferably from 10 to 60 seconds, and the processing temperature is from 25 to 60° C., preferably from 30 to 50° C. The replenishing rate is from 20 to 250 ml per $m^2$ of the photographic material, preferably from 30 to 100 ml, and particularly preferably from 15 to 60 ml.

In color development process, desilvering process is generally followed by washing or stabilizing process, and in black-and-white development process, washing process is generally performed after fixing process.

The amount of washing water in the washing step can be selected from a wide range according to the characteristics and the application of the photographic materials (for example, the materials used such as couplers, etc.), the temperature of washing water, the number of washing tanks (the number of washing stages), and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pp. 248 to 253 (May, 1955). The number of stages in a multistage countercurrent system is generally preferably from 3 to 15, particularly preferably from 3 to 10.

According to the multistage countercurrent system, the amount of the washing water can be greatly reduced, however, problems arise that bacteria proliferate due to the increased residence time of the water in the tanks, and suspended matters produced thereby adhere to the photographic material. Using the above-described stabilizing bath containing antibacterial and antifungal agents is very effective means for overcoming these problems.

The pH of the washing step and stabilizing step is preferably from 4 to 10, more preferably from 5 to 8. The temperature can be set up according to various uses and characteristics of the photographic material but is generally from 20 to 50° C., preferably from 25 to 45° C.

Drying step is performed following washing and/or stabilizing steps. It is possible to expedite drying by absorbing water of the material fresh from the washing tank by means of a squeegee and cloth from the viewpoint of reducing the carryover of water to the image film. As the improving means from the drier side, although it is a matter of course, drying can be expedited by increasing temperature and modulating the shape of nozzles to strengthen the dry air. Further, as is disclosed in JP-A-3-157650, the adjustment of the angle of air blowing and discharging method of the exhaust air are also effective to speed up drying.

The development processing methods with the granulated processing agents according to the present invention have been described above. The development processing apparatus for performing the development processing will be described below.

The development processing of the present invention is performed with an automatic processor. Automatic processors which are preferably used in the present invention are described below.

It is preferred in the present invention that the linear velocity of the conveyance of the automatic processor is preferably 5,000 mm/min or less, more preferably from 200 to 4,500 mm/min, and particularly preferably from 500 to 3,000 mm/min.

It is preferred that the contact area of air with the processing solution in a processing tank and a replenisher tank (open area) of the present invention is as small as possible. For example, when the open factor is the value obtained by dividing the open area ($cm^2$) by the volume of the processing solution in the tank ($cm^3$), the open factor is preferably 0.01 ($cm^{-1}$) or less, morepreferably 0.005 or less, and most preferably 0.001 or less.

It is preferred to provide a solid or liquid non-contact means with air which is floating on the surface of the solution in a processing tank or a replenisher tank to reduce the open area.

Specifically, means of covering the surface of the solution with a floating lid of plastics or shielding with a liquid immiscible with and not chemically reacting with a processing solution are preferred. Liquid paraffin and liquid saturated hydrocarbon are preferred examples of such liquids.

The crossover time required for a photographic material to transfer from one processing tank to another processing tank in the air is preferred to be as short as possible for carrying out processing rapidly, preferably 10 seconds or less, more preferably 7 seconds or less, and most preferably 5 seconds or less. The use of a cinema type automatic processor is preferably used in the present invention for achieving such a short crossover time, in particular, a leader conveyance system is preferred. Such a system is adopted in an automatic processor FP-560B, a product of Fuji Photo Film Co., Ltd.

The belt conveyor systems disclosed in JP-A-60-191257, JP-A-60-191258 and JP-A-60-191259 are preferred as a conveying system of a leader or a photographic material. Further, the structure of a crossover rack which is provided with a mixture inhibiting plate is preferably used in the present invention for shortening the crossover time and inhibiting the mixture of the processing solutions.

It is preferred in the present invention that the amounts corresponding to the evaporated processing solutions be supplemented with water, that is, a so-called evaporation compensation, and it is particularly preferred with regard to a color developing solution, a bleaching solution and a blixing solution.

There is no particular limitation on the method of supplementing water, but the following methods are preferred above all, e.g., a method in which a monitoring water tank is arranged separately from the bleaching tank, and the amount of water evaporated from the bleaching tank is calculated from the amount of water evaporated from the monitoring water tank, and water is replenished to the bleaching tank in proportion to this amount of evaporation, which is disclosed in JP-A-1-254959 and JP-A-1-254960, and a method in which a liquid level sensor or an overflow sensor is used to compensate for the evaporated amount of water. The most preferred evaporation compensation method is a method in which the presumed amount of water corresponding to the evaporation amount calculated from the coefficient determined in advance based on the data of operating time, stopping time and temperature controlling time of the automatic processor is added, which is disclosed in *Nippon Hatsumei Kyokai Kokai Giho,* 94-49925, line 26, right column, page 1 to line 28, left column, page 3.

Further, means to reduce the evaporation amount are necessary, for example, reducing the open area or controlling the air capacity of an exhaust fan are required. As the preferred open factor of a color developing solution is as described above, it is preferred to reduce open areas with respect to other processing solutions as well.

As a means to decrease the evaporation amount, "maintaining the humidity of the upper space of the processing tank at 80% RH or more" as disclosed in JP-A-6-110171 is particularly preferred, and it is preferred to be provided with the automatic washer for the evaporation preventing racks and rollers illustrated in FIGS. 1 and 2 of the above patent. An exhaust fan is generally provided for preventing the dew condensation during temperature controlling.

Drying conditions of photographic materials also affect the evaporation of processing solutions. The use of a hot air heater made of ceramic is a preferred drying system, and the supplying air capacity is preferably from 4 $m^3$ to 20 $m^3$, and particularly preferably from 6 $m^3$ to 10 $m^3$, per minute.

A superheating preventing thermostat of a hot air heater made of ceramic is preferably a system actuated by heat transfer and is preferably installed on the leeward side or on the windward side through the radiation fin or the heat transfer part. Drying temperature is preferred to be controlled according to the water content of the photographic material to be processed, and the optimal temperature ranges are from 45 to 55° C. in the case of a 35 mm width film and from 55 to 65° C. in the case of a Brownie film.

As a replenishing pump is used in the replenishment of processing solutions, a bellows type replenishing pump is preferred. As a method of improving the accuracy of replenishment, making the diameter of a liquid pipe to a replenishing nozzle smaller is effective to prevent the back-flow at stopping time.

Drying time is preferably from 5 seconds to 2 minutes and particularly from 5 seconds to 60 seconds.

Continuous processing primarily by a replenishment system has been described hitherto, however, a batch system in which processing is performed with a fixed amount of a processing solution without replenishing in a development step and the succeeding steps, subsequently processing is performed again by replacing the entire or a partial processing solution with a new processing solution can also be used in the present invention.

The granulated processing agent according to the present invention may be supplied directly to a processor as the granular composition in the form of one part type or may be supplied in the form of a plural part type compositions, alternatively the processing agent may be dissolved to prepare a replenisher and the replenisher may be replenished from a replenisher tank under controlling.

A mode in which a bottle containing the granulated processing agent is installed in the processor by turning the bottle upside down, then the cap is opened and the content (granules) is put into a replenishing tank to be dissolved with water is also preferred. It is preferred to use the water in a washing water replenishing tank for dissolution. Further, the granules may be directly replenished to a processing tank as they are and the corresponding water for dilution may be directly replenished to the processing tank. This mode of replenishment is preferred for a compact processor not having a special replenishing tank.

With the case of the granulated processing agent comprising a plurality of parts, by installing each part of the granules at the upper part of the replenishing tank of a processor, the granules can be automatically dissolved in the replenishing tank similarly to the above. It is preferred to use the water in a washing water replenishing tank for dissolution. Further,the granules of each part maybe directly replenished to a processing tank as they are and the corresponding water for dilution may be directly replenished to the processing tank.

The stabilizing solution disclosed in JP-A-6-289559 can be preferably used to reduce the adhesion of dusts onto the magnetic layer coated on a photographic material.

The processing specification described in *Nippon Hatsumei Kyokai Kokai Giho,* 94-4992, line 15, right column, page 3 to line 32, left column, page 4 can be preferably applied to the granular type processing agent for use in the present invention. The film processor described in ibid., lines 22 to 28, right column, page 3 is preferably used for this purpose.

Specific examples of the preferred automatic processors and evaporation compensation methods suitable for putting the granular type processing agent according to the present invention into practical use are described in the above *Nippon Hatsumei Kyokai Kokai Giho*, line 11, right column, page 5 to the last line, right column, page 7.

In the next place, the photographic materials for use in the present invention are described.

As described above in concerning with the object and the background of the present invention, the photographic materials for use in the present invention are color photographic materials for photographing, color photographic paper, black-and-white photographic materials for photographing, and black-and-white photographic paper which are generally used in the photographic market. These photographic material comprise at least one light-sensitive layer on a support. In a typical embodiment, the silver halide photographic material of the present invention comprises at least one light-sensitive layer consisting of a plurality of silver halide emulsion layers having substantially the same spectral sensitivity but different degrees of sensitivity on a support.

In the multilayer silver halide color photographic material for photographing, the light-sensitive layer is a unit light-sensitive layer having a spectral sensitivity to any of blue light, green light and red light, and these unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed JP-B-55-34932. Further, a blue-sensitive layer/GL/

RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

For improving color reproducibility, a donor layer (CL) for an interlayer effect having a different spectral sensitivity distribution from a main light-sensitive layer such as BL, GL and RL may preferably be provided adjacent or close to the main light-sensitive layer, as disclosed in U.S. Pat. Nos. 4,663,271, 4,705,744, 4,707,436, JP-A-62-160448 and JP-A-63-89850.

The silver halides preferably used in the materials for photographing are silver iodobromide, silver iodochloride or silver iodochlorobromide containing about 30 mol % or less of silver iodide, and particularly preferably used are silver iodobromide or silver iodochlorobromide containing from about 2 mol % to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms.

Silver halide grains are used in a wide range since the silver halide grains having a grain size suitable for each light-sensitive layer are prepared, e.g., fine size grains having a projected area diameter of from 0.1 to 0.2 $\mu$m, or large size grains of from 1.0 up to 10 $\mu$m are used, and the emulsion may be a polydispersed emulsion or a monodispersed emulsion.

It is preferred to use light-insensitive fine grained silver halides in color photographic materials. Light-insensitive fine grained silver halides are fine grained silver halides which are not sensitive to light upon imagewise exposure for obtaining color images and which do not substantially undergo development during development processing, and they are preferably not pre-fogged. Fine grained silver halides have a silver bromide content of from 0 to 100 mol %, and may contain silver chloride and/or silver iodide, if necessary. Fine grained silver halides which have a silver iodide content of from 0.5 to 10 mol % are preferred. The average grain size of fine grained silver halides (the average value of the equivalent-circle diameters) is preferably from 0.01 to 0.5 $\mu$m, more preferably from 0.02 to 0.2 $\mu$m.

Fine grained silver halide can be prepared by the same methods as the preparation of generally used light-sensitive silver halides. In the preparation of fine grained silver halide, the surface of the silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in the fine grained silver halide before addition to the coating solution. Colloidal silver can be included in the layer containing the fine grained silver halide grains.

The coating weight of silver in the color photographic material for use in the present invention is preferably 6.0 g/m$^2$ or less, and most preferably 4.5 g/m$^2$ or less.

The color photographic material for use in the present invention has a total film thickness of all the hydrophilic colloid layers on the side where the emulsion layers are located of preferably 28 $\mu$m or less, more preferably 23 $\mu$m or less, still more preferably 18 $\mu$m or less, and most preferably 16 $\mu$m or less. Further, the film swelling rate $T_{1/2}$ is preferably 30 seconds or less, more preferably 20 seconds or less. $T_{1/2}$ is defined as the time required for the film thickness to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% RH (stored for two days), and $T_{1/2}$ can be measured using a swellometer of the type described in A. Green et al., *Photogr. Sci. Eng.*, Vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation:

(maximum swollen film thickness−film thickness)/film thickness.

On the other hand, silver halide grains contained in a photographic emulsion preferably used in forming a print may have a regular crystal form such as a cubic, tetradecahedral or octahedral form or an irregular crystal form such as a spherical or plate-like form, or a form which is a composite of these forms.

A pair of parallel planes vertical to the thickness direction of a tabular grain is called main planes. In the present invention, a photographic emulsion containing tabular grains having {111} planes as the main planes or {100} planes as the main planes is preferably used.

With respect to {111} tabular grains, various methods of using crystal phase controlling agents are disclosed, e.g., the compounds disclosed in JP-A-2-32 (Exemplified Compounds 1 to 42) are preferably used.

High silver chloride grains means the grains having the silver chloride content of 80 mol % or more, and grains having the silver chloride content of 95mol % or more are preferred. The silver halide grains for use in the present invention preferably have core/shell structure comprising a core part and a shell part surrounding the core part. It is preferred that silver chloride accounts for 90 mol % or more of the core part. The core part may comprise two or more parts having different halogen compositions. It is preferred that the shell part accounts for 50% or less of the entire grain volume, particularly preferably 20% or less. The shell part preferably comprises silver iodochloride or silver iodobromochloride. The shell part preferably contains from 0.5 to 13 mol % of iodide, particularly preferably from 1 to 13 mol %.

The content of silver iodide in the entire grain is preferably 5 mol % or less, particularly preferably 1 mol % or less.

It is preferred that silver bromide is contained in higher concentration in the shell part than in the core part. The content of silver bromide is preferably 20 mol % or less, particularly preferably 5 mol % or less.

The average grain size (the equivalent-sphere diameter in terms of volume) of the silver halide grains for use in the photographic material for photographic paper is not particularly restricted but is preferably from 0.1 to 0.8 μm, particularly preferably from 0.1 to 0.6 μm. The equivalent-circle diameter of a tabular grain is preferably from 0.2 to 1.0 μm. The diameter of a silver halide grain used in the present invention is the diameter of a circle having the same area with the projected area of the grain in an electron microphotograph. The thickness of a tabular grain in the present invention is 0.2 μm or less, preferably 0.15 μm or less, and particularly preferably 0.12 μm or less.

The grain size distribution of the silver halide grains in the present invention may be polydispersion or monodispersion but monodispersed grains are preferred. In particular, the variation coefficient of the equivalent-circle diameter of the tabular grains accounting for 50% or more of the entire projected area is preferably 20% or less, ideally 0%.

Color photographic materials for photographing and for manufacturing a print are described below.

The silver halide photographic emulsions for use in the present invention can be prepared using the methods described, for example, in *Research Disclosure* (hereinafter abbreviated to *RD*), No.17643 (December, 1978), pages 22 and 23, "I. Emulsion Preparation and Types", *RD*, No. 18716 (November, 1979), page 648, *RD*, No. 307105 (November, 1989), pages 863 to 865, P. Glafkides, *Chimieet Physique Photographique*, PaulMontel (1967), G. F. Duffin, *Photographic Emulsion Chemistry*, Focal Press (1966), and V. L. Zelikman et al., *Making and Coating Photographic Emulsion*, Focal Press (1964).

The monodispersed emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods described, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a layered structure. Silver halides which have different compositions may be joined with an epitaxial junction or may be joined with compounds other than a silver halide, such as silver thiocyanate or lead oxide. Further, mixtures of grains which have various crystal forms may also be used.

The above described emulsions may be of the surface latent image type wherein the latent image is primarily formed on the surface, or of the internal latent image type wherein the latent image is formed within the grains, or of a type wherein the latent image is formed both on the surface and within the grains, but a negative type emulsion is essential. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in *RD*, No. 17643, *RD*, No. 18716, and *RD*, No. 307105; and the locations of these disclosures are summarized in a table below.

In the color photographic material of the present invention, two or more different types of emulsions which are different in terms of at least one of the characteristics of grain size, grain size distribution, halogen composition, the form of the grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation of such silver halide grains are disclosed in U.S. Pat. No. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide.

The photographic additives which can be used in a color photographic material are also described in *RD*'s and the locations related thereto are indicated in the following table.

| Type of Additives | RD 17643 | RD 18716 | RD307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbers, Filter Dyes, and Ultraviolet Absorbers | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various dye-forming couplers can be used in the color photographic material, and the following couplers are particularly preferred.

Yellow Couplers:

The couplers representedbyformula (I) or (II) disclosed in EP-A-502424; the couplers represented by formula (1) or (2)

disclosed in EP-A-513496 (in particular, Y-28 on page 18); the couplers represented by formula (I) disclosed in claim 1 of EP-A-568037; the couplers represented by formula (I), column 1, lines 45 to 55 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), lines 36 to 58, column 7 of U.S. Pat. No. 4,476,219 (in particular, II-17 and II-19 (column 17), and II-24 (column 19)).

Magenta Couplers:

L-57 (page 11, right lower column), L-68 (page 12, right lower column), and L-77 (page 13, right lower column) of JP-A-3-39737; [A-4]-63 (page 134), and [A-4]-73 and [A-4]-75 (page 139) of EP-A-456257; M-4 and M-6 (page 26) and M-7 (page 27) of EP-486965; M-45 (page 19) of EP-A-571959; (M-1) (page 6) of JP-A-5-204106; andM-22, paragraph 0237 of JP-A-4-362631.

Cyan Couplers:

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

Couplers the colored dyes of which have an appropriate diffusibility:

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for correcting the unnecessary absorption of colored dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds which release photographically useful groups include the following:

Development inhibitor-releasing compounds:

the compounds represented by formula (I), (II), (III) or (IV) disclosed on page 11 of EP-A-378236;

Bleaching accelerator-releasing compounds:

the compounds represented by formula (I) or (I') disclosed on page 5 of EP-A-310125;

Ligand-releasing compounds:

the compounds represented by LIG-X disclosed in claim 1 of U.S. Pat. No. 4,555,478;

Leuco dye-releasing compounds:

Compounds 1 to 6, columns 3 to 8 of U.S. Pat. No. 4,749,641;

Fluorescent dye-releasing compounds:

the compounds disclosed in claim 1 of U.S. Pat. No. 4,774,181;

Development accelerator-releasing or fogging agent-releasing compounds:

the compounds represented by formula (1), (2) or (3), column 3 of U.S. Pat. No. 4,656,123; and Compounds which release dyes the color of which is restored after elimination:

the compounds represented by formula (I) disclosed in claim 1 of U.S. Pat. No. 4,857,447.

Preferred additives other than couplers are well-known dispersion mediums of oil-soluble organic compounds, latexes for impregnation of oil-soluble organic compounds, scavengers for the oxidation products of developing agents, stain inhibitors, discoloration inhibitors, hardening agents, development inhibitor precursors, stabilizers, antifoggants, chemical sensitizers, dyes, crystallite dispersions of dyes, and ultraviolet absorbers.

The present invention can be applied to various color photographic materials such as color negative films for general and cinematographic uses, color reversal films for slide and television uses, color photographic papers, and color positive films. The present invention can also preferably be applied to the film units equipped with lenses as disclosed in JP-B-2-32615 and JP-B-U-3-39784 (the term "JP-B-U" as used herein means an "examined Japanese utility model publication").

Suitable supports which can be used in the present invention are disclosed, for example, in *RD*, No. 17643, page 28, *RD*, No. 18716, from page 647, right column to page 648, left column, and *RD*, No. 307105, page 879.

The provision of hydrophilic colloid layers (known as backing layers) having a total dry film thickness of from 2 $\mu$m to 20 $\mu$m on the side of the support opposite to the side on which emulsion layers are provided is preferred in the color photographic material of the present invention. The inclusion of the above described light absorbing agents, filter dyes, ultraviolet absorbers, antistatic agents, hardening agents, binders, plasticizers, lubricants, coating aids, and surfactants in the backing layers is preferred. The swelling factor of the backing layer is preferably from 150 to 500%.

The color photographic materials for use in the present invention have a magnetic layer in many cases. The magnetic layer is a layer coated on a support with an aqueous or organic solvent based coating solution comprising magnetic particles dispersed in a binder.

A reflective support is used in color photographic paper for color print. As the reflective support, a reflective support, which is laminated with a plurality of polyethylene layers and polyester layers and at least one of such water resistant resin layers (laminated layers) contains a white pigment, e.g., titanium oxide, is preferred.

Further, a brightening agent is preferably contained in the above water resistant resin layers. A brightening agent may be dispersed in a hydrophilic colloid layer of the photographic material. Preferred brightening agents are benzoxazole-based, coumarin-based, and pyrazoline-based brightening agents, and more preferred are benzoxazolylnaphthalene-based and benzoxazolylstilbene-based brightening agents. The addition amount is not particularly limited but is preferably from 1 to 100 mg/m$^2$. The mixing ratio when they are mixed with a water resistant resin is preferably from 0.0005 to 3 wt %, more preferably from 0.001 to 0.5 wt %, to the resin.

A transmitting type support and the above-described reflective type support coated with a hydrophilic colloid layer containing a white pigment may also be used as the reflective type support.

A reflective type support having a mirror reflective property or second kind diffuse reflective metal surface may also be used.

A cellulose triacetate support and a polyester support are used for a color photographic material for photographing, and the details thereof are described in *Kokai-Giho*, Kogi No. 94-6023 (Hatsumei-Kyokai, Mar. 15, 1994).

Polyester is formed with diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols diethylene glycol, triethylene glycol, cyclohexanedimethanol, bisphenol A, and bisphenol can be enumerated. Polymerized polymers thereof include homopolymers such as polyethylene terephthalate, polyethylene naphthalate, polycyclohexanedimethanol terephthalate and the like. Particularly preferred is polyester containing from 50 mol % to 100 mol % of 2,6-naphthalenedicarboxylic acid. Particularly preferred above all is polyethylene 2,6-naphthalate. The average molecular weight of polyester is about 5,000 to 200,000. Tg of the polyester for use in the present invention is 50° C. or more, and 90° C. or more is preferred.

An ultraviolet absorber may be incorporated into the polyester support. Further, light piping can be prevented by incorporating the commercially available dye or pigment for polyester such as Diaresin manufactured by Mitsubishi Chemical Corp. or Kayaset manufactured by Nippon Kayaku Co., Ltd. into polyester.

To ensure adhesion of the support and the constitutional layers of the photographic material for use in the present invention, the surface activation treatment is preferably performed after coating an undercoat layer or directly on the surface, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of these surface activation treatments are an ultraviolet irradiation treatment, a flame treatment, a corona discharge treatment, and a glow discharge treatment.

Antistatic agents are preferably used in the present invention, e.g., polymers containing carboxylic acid, carboxylate, and sulfonate, cationic polymer, and ionic surfactant compounds can be exemplified.

The most preferred antistatic agents are fine particles of a crystalline metallic oxide of at least one particle selected from zinc oxide, silicon dioxide, titanium dioxide, alumina, indium oxide, magnesium oxide, barium oxide, manganese oxide, and vanadium oxide having a volume resistivity of $10^7$ Ω·cm or less, more preferably $10^5$ Ω·cm or less and having a particle size of from 0.001 to 1.0 μm, or fine particles of composite oxides of them (Sb, P, B, In, S, Si, C), further, fine particles of a metallic oxide in the form of sol or fine particles of these composite oxides. The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

It is preferred for the color photographic material of the present invention to have a sliding property. The sliding agent-containing layer is preferably provided on both of light-sensitive layer surface and backing layer surface. Preferred sliding property is a dynamic friction coefficient of from 0.25 to 0.01. Measurement at this time is conducted using a stainless steel ball having a diameter of 5 mm at a conveying speed of 60 cm/min (25° C., 60% RH). In this evaluation, when the opposite material is replaced with the light-sensitive layer surface, almost the same level of value can be obtained.

Examples of the sliding agent which can be used in the present invention include polyorganosiloxane, higher fatty acid amide, higher fatty acid metal salt, higher resin acid and higher alcohol ester. As polyorganosiloxane, polydimethylsiloxane, polydiethylsiloxane, polystyrylmethylsiloxane, and polymethylphenylsiloxane can be used. The sliding agent is preferably added to the outermost layer of an emulsion layer or a backing layer. In particular, polydimethylsiloxane or esters having a long chain alkyl group are preferred.

The color photographic material of the present invention preferably contains a matting agent. The matting agent may be added to either of the emulsion layer side or the backing layer side but particularly preferred added to the outermost layer of the emulsion layer side. The matting agent may be either soluble or insoluble in the processing solution, preferably both types are used in combination. For example, polymethylmethacrylate, poly(methyl methacrylate/methacrylic acid=9/1 or 5/5 (mol ratio)), and polystyrene particles are preferably used. The particle size is preferably from 0.8 to 10 μm, and particle size distribution is preferably narrow, preferably from 0.9 to 1.1 times of the average particle size is occupied by 90% or more of the entire particle number. For increasing the matting property, fine particles having a particle size of 0.8 μm or less are preferably added at the same time. For example, polymethylmethacrylate (0.2 μm), poly(methyl methacrylate/methacrylic acid=9/1 (mol ratio), 0.3 μm), polystyrene particles (0.25 μm), and colloidal silica (0.03 μm) are enumerated.

The color photographic materials which are used in the present invention have been described above. The explanations about the color photographic materials for photographing and print-making are substantially applied to the positive black-and-white photographic materials for photographing and print-making exclusive of the part concerning coloring.

Generally used printers are used for producing prints by the development processing using the granulated processing agent according to the present invention but, in addition to a print system using a general negative printer, the present invention is suitably used in a scanning exposure system using a cathode ray tube (CRT).

A cathode ray tube exposure apparatus is simple and compact as compared with an apparatus using laser beams, costs can be saved and the adjustment of optical axis and colors is easy.

Various light emitters showing emission in spectral regions according to necessity are used in a cathode ray tube for use for image exposure. For example, any one of red emitter, green emitter and blue emitter, or mixture of two or more of these are used. Spectral regions are not limited to the above red, green and blue, and phosphors emitting lights in yellow, orange, violet and infrared regions are also used. A cathode ray tube which emits white light by mixing these emitters is often used.

When the photographic material has a plurality of light-sensitive layers having different spectral sensitivity distributions and the cathode ray tube also has phosphors emitting lights in a plurality of spectral regions, a plurality of colors may be exposed at the same time, i.e., image signals of a plurality of colors may be inputted to the cathode ray tube and emitted from the tube surface. Alternatively, an exposure method comprising inputting an image signal of each color in order and emitting light of each color in order through a film cutting other colors except for that color (sequential face exposure) may be adopted. In general, sequential face exposure is preferred for obtaining a high quality image because a cathode ray tube having high resolving power can be used.

The photographic material of the present invention is preferably used in a digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the maximum wavelength of the spectral sensitivity of the photographic material of the present invention can be set arbitrarily according to the wavelength of the scanning exposure light source to be used. As oscillation wavelength of a laser can be made half using an SHG light source comprising a combination of nonlinear optical crystal with a solid state laser using a semiconductor laser as an excitation light source or a semiconductor laser, blue light and green light can be obtained. Accordingly, it is possible that normal three regions of blue, green and red have the spectral sensitivity maximum of a photographic material.

The exposure time in such a scanning exposure is defined as the time necessary to expose a pixel size with the pixel density being 400 dpi, and preferred exposure time is $10^{-4}$ sec or less and more preferably $10^{-6}$ sec or less.

For the purpose of inhibiting the duplication without permission of the photographic material subjected to the treatment according to the present invention, it is possible to give a latent image of a micro dot pattern to the photographic material. This method is disclosed in JP-A-9-226227.

Preferred scanning exposure systems which can be applied to the present invention are disclosed in detail in the patents described in the above table.

For processing the photographic material according to the present invention, processing materials and processing methods disclosed in JP-A-2-207250, line 1, right lower column, page 26 to line 9, right upper column, page 34; and JP-A-4-97355, line 17, left upper column, page 5 to line 20, right lower column, page 18 can be preferably used.

EXAMPLE

The present invention will be illustrated in detail with reference to the examples below, but these are not to be construed as limiting the invention.

Example 1

A granulated processing agent was prepared according to the following method using the constitutional compounds of a color developer shown below.

| Components constituting color developer | |
|---|---|
| Component A: | |
| Lithium hydroxide monohydrate | 620 g |
| Component B: | |
| Potassium carbonate | 1,200 g |
| Component C: | |
| Sodium sulfite | 10 g |

-continued

| Components constituting color developer | |
|---|---|
| Component D: | |
| Sodium p-toluenesulfonate | 910 g |
| Component E: | |
| Triazinyl aminostilbene-based brightening agent (Hakkol FWA-SF, manufactured by Showa Kagaku Kogyo Co., Ltd.) | 370 g |
| Component F: | |
| Disodium ethylenediaminetetraacetate | 230 g |
| Component G: | |
| Disodium-N,N-bis(sulfonatoethyl)hydroxylamine | 640 g |
| Component H: | |
| Disodium 4,5-dihydroxybenzene-1,2-disulfonate | 20 g |
| Component I: | |
| N-Ethyl-N-(β-methanesulfonamidoethyl)-3-methyl-4-amino-4-aminoaniline.3/2 sulfate. monohydrate | 1,000 g |

Granulation of granules

Granulated Product 1-1:

Components A to H were crushed with a commercially available manner mill until the average particle diameter became 20 μm or less, and crushed Components A to H were mixed and thoroughly kneaded. The mixture obtained was granulated to spherical granules having an average diameter of 3 mm with spraying water as a binder with an agitation granulator, and then the granules were dried, thereby Granulated Product 1-1 was obtained.

Granulated Product 1-2:

Component D was granulated to an undefined granulated product having an average particle diameter of 1 mm with a roller compactor. Components A to C and E to H were then crushed with a commercially available manner mill until the average particle diameter became 20 μm or less. Crushed Components E, F, G and H were thoroughly mixed collectively. Crushed Components A, B and C were thoroughly mixed collectively as another mixture. Subsequently, the mixture of Components E, F, G and H was added on the surface of the internal nucleus with the granulated product of Component D as the internal nucleus while spraying water as a binder by a centrifugal fluidizing type coating granulator to thereby form a coating layer. Then, the mixture of Components A, B and C was coated on the coating layer of the mixture of Components E, F, G and H with a centrifugal fluidizing type coating granulator in the same manner as above. The obtained product was dried, thereby core/shell type spherical granules having an average particle size of 3 mm were obtained (two coating layers), which was designated Granulated Product 1-2.

Granulated Product 1-3:

Component A was granulated to an undefined granulated product having an average particle diameter of 1 mm with a roller compactor. Each of Components B to H was then crushed with a commercially available manner mill until the average particle diameter became 20 μm or less. Crushed Components B to H were thoroughly mixed collectively. Then, the mixture of Components B to H was coated on the surface of the internal nucleus with the granulated product of Component A as the internal nucleus by a centrifugal fluidizing type coating granulator in the same manner as in the preparation of Granulated Product 1-2. The obtained product was dried, thereby core/shell type spherical granules having an average particle size of 3 mm were obtained (one coating layer), which was designated Granulated Product 1-3.

Granulated Product 1-4:

Component A was granulated to an undefined granulated product having an average particle diameter of 1 mm with a roller compactor. Each of Components B to H was then crushed with a commercially available manner mill until the average particle diameter became 20 μm or less. Crushed Components C to H were thoroughly mixed collectively. Then, Component B was coated on the surface of the internal nucleus with the granulated product of Component A as the internal nucleus by a centrifugal fluidizing type coating granulator in the same manner as in the preparation of Granulated Product 1-2. In the next place, the mixture of Components C to H was coated on the coating layer of Component B with a centrifugal fluidizing type coating granulator. The obtained product was dried, thereby core/shell type spherical granules having an average particle size of 3 mm were obtained (two coating layers), which was designated Granulated Product 1-4.

Granulated Product 1-5:

Component A was granulated to an undefined granulated product having an average particle diameter of 1 mm with a roller compactor. Each of Components B to H was then crushed with a commercially available manner mill until the average particle diameter became 20 μm or less. Crushed Components C and D and Components G and H were respectively thoroughly mixed. Then, Component B was coated on the surface of the internal nucleus with the granulated product of Component A as the internal nucleus by a centrifugal fluidizing type coating granulator in the same manner as in the preparation of Granulated Product 1-2. In the next place, the mixture of Components C and D was coated on the coating layer of Component B with a centrifugal fluidizing type coating granulator. Then, Component E was coated on the coating layer of the mixture of Components C and D by a centrifugal fluidizing type coating granulator in the same manner as above. Then, Component F was coated on the coating layer of Component E by a centrifugal fluidizing type coating granulator in the same manner as above. Then, the mixture of Components G and H was coated on the coating layer of Component F with a centrifugal fluidizing type coating granulator in the same manner as above. The obtained product was dried, thereby core/shell type spherical granules having an average particle size of 3 mm were obtained (five coating layers), which was designated Granulated Product 1-5.

Granulated Product 1-6:

Polyethylene glycol 6000 in an amount of 5 mass % of the entire mass of Granulated Product 1-5 was spray-coated on the surface of Granulated Product 1-5 by a fluidized bed granulating coating machine, the thus-obtained product was designated Granulated Product 1-6.

Granulated Product 1-7:

Component I was crushed with a commercially available manner mill until the average particle diameter became 20 μm or less, and crushed Component I was granulated to spherical granules having an average diameter of 3 mm with spraying water as a binder with an agitation granulator, and then the granules were dried, thereby Granulated Product 1-7 was obtained.

Each of Granulated Products 1-1 to 1-6 was mixed with Granulated Product 1-7 in mass ratio of 4/1, and 1 kg of each sample thus prepared was taken in a beaker and allowed to stand in a room at 30° C. and relative humidity of 80% in open state for 10 days. Moisture absorption amount and the variation of form (solidifying property) were evaluated. The results obtained are shown in Table 1. Moreover, the critical relative humidities of the internal nucleus and the coating layer at 30° C. of each of Granulated Products 1-1 to 1-6 were measured and the results obtained are shown in Table 1. The measurement of moisture absorption amount was performed by weighing the mass change of each product in mixed form, and shown in Table 1 in mass %.

TABLE 1

| Exp. No. | Granulated Product | Critical Relative Humidity of Internal Nucleus (%) | Critical Relative Humidity of 1st Coating Layer (%) | Critical Relative Humidity of 2nd Coating Layer (%) | Remarks | Moisture Absorption Rate (%) (absorption amount/mass of granules) | Variation of Form (solidifying property) |
|---|---|---|---|---|---|---|---|
| 1 | mixture of 1-1 and 1-7 | — | — | — | Comparison | 80 | granules liquefied |
| 2 | mixture of 1-2 and 1-7 | 97 | 15 | 90 | Comparison | 65 | excessive solidification, granular property and flow property was not restored even with high impact |
| 3 | mixture of 1-3 and 1-7 | 25 | 70 | — | Invention | 8 | light solidification, flow property was restored with slight impacts five times |
| 4 | mixture of 1-4 and 1-7 | 25 | 50 | 92 | Invention | 5 | light solidification, flow property was restored with slight impacts twice |
| 5 | mixture of 1-5 and 1-7 | 25 | 50 | 92 | Invention | 3 | light solidification, flow property was restored with slight impact once |
| 6 | mixture of 1-6 and 1-7 | 25 | 50 | 97 | Invention | 1 | did not solidify at all |

Note

The values of the critical relative humidity were the values of Granulated Products 1-1 to 1-6 respectively.

It can be seen from the results shown in Table 1 that in the prescription of containing lithium hydroxide, Granulated Products 1-3 to 1-6 which contained lithium hydroxide as the internal nucleus showed low moisture absorption and hardly solidified, thus satisfactory results could be obtained. In Granulated Product 1-1 which did not have core/shell structure, moisture absorption amount was high and granules liquefied with the lapse of time, thus this sample was impracticable. Granulated Product 1-2 was a core/shell type sample but moisture absorption amount was high and excessive solidification was seen because this sample did not contain lithium hydroxide in the internal nucleus but contained in the coating layer.

Further, among the samples according to the present invention, preferred results could be obtained in the case where the coating layer was comprised of 2 or more layers and the polymer was coated as the outermost layer.

Example 2

Granulated Products 1-7 to 1-10 were prepared in the same manner as the preparation of Granulated Product 1-6 except that the average particle size of the internal nuclei, the average particle size of the granules and the content of the granules having an average particle size of 0.5 mm or less were changed as shown in Table 2. Moisture absorption amount and the variation of form (solidifying property) were evaluated in the same manner as in Example 1, and the results obtained are shown in Table 2. The measured value of moisture absorption amount in Table 2 was also shown in mass %.

TABLE 2

| Exp. No. | Granulated Product | Average Particle Size of Internal Nuclei (mm) | Average Particle Size of Granules (mm) | Content of Granules Having Particle Diameter of 0.5 mm or less | Remarks | Moisture Absorption Rate | Variation of Form (solidifying property) |
|---|---|---|---|---|---|---|---|
| 1 | Mixture of 1-6 and 1-11 | 1 | 3 | 0 | Invention | 1 | did not solidify at all |
| 2 | Mixture of 1-7 and 1-11 | 0.3 | 0.8 | 0 | Comparison | 1 | light solidification, flow property was restored with slight impacts five times |
| 3 | Mixture of 1-8 and 1-11 | 6.0 | 25 | 0 | Comparison | 1 | light solidification, flow property was restored with slight impacts three times |
| 4 | Mixture of 1-9 and 1-11 | 1 | 3 | 8 | Invention | 3 | light solidification, flow property was restored with slight impacts twice |
| 5 | Mixture of 1-10 and 1-11 | 1 | 3 | 15 | Comparison | 5 | light solidification, flow property was restored with slight impacts four times |

Note
Average particle size of internal nuclei, average particle size of granules, content of small size particles were those of Granulated Products 1-6 to 1-10 (Granulated Product 1-11 was granule of developing agent).

Of the samples according to the present invention, when the average particle diameter of the internal nuclei was from 0.5 to 5 mm, when the average particle size of the granules was from 1 to 20 mm, and when the granules having particle diameter of 0.5 mm or less accounted for 10 mass % or less of the entire mass of the granules, moisture absorption amount was low and good results were obtained.

Example 3

A granulated processing agent was prepared according to the following method using the constitutional compounds of a blixing agent shown below.

| Blixing component | |
|---|---|
| Component A: | |
| Mixture of ammonium thiosulfate and sodium thiosulfate (9/1 by mass ratio) | 2,000 g |
| Component B: | |
| Sodium sulfite | 1,100 g |
| Component C: | |
| Disodium ethylenediaminetetraacetate | 100 g |
| Component D: | |
| Ammonium ethylenediaminetetraacetato ferrate | 1,100 g |
| Component E: | |
| Succinic acid | 700 g |

Granulated Product 3-1:

Components A to E were crushed with a commercially available manner mill until the average particle diameter became 20 $\mu$m or less, and crushed Components A to E were mixed and thoroughly kneaded. The mixture obtained was granulated to spherical granules having an average diameter of 3 mm with spraying water as a binder with an agitation granulator, and then the granules were dried, thereby Granulated Product 3-1 was obtained.

Granulated Product 3-2:

Component D was granulated to an undefined granulated product having an average particle diameter of 1 mm with a roller compactor. Components A, B, C and E were then crushed with a commercially available manner mill until the average particle diameter became 20 $\mu$m or less. Crushed Components A and B were thoroughly mixed collectively. Crushed Components C and E were thoroughly mixed collectively as another mixture. Subsequently, the mixture of Components C and E was coated on the surface of the internal nucleus with the granulated product of Component D as the internal nucleus while spraying water as a binder by a centrifugal fluidizing type coating granulator to thereby form a coating layer. Then, the mixture of Components A and B was coated on the coating layer of the mixture of Components C and E with a centrifugal fluidizing type coating granulator in the same manner as above. The obtained product was dried, thereby core/shell type spherical granules having an average particle size of 3 mm were obtained (two coating layers), which was designated Granulated Product 3-2.

Granulated Product 3-3:

Component A was granulated to an undefined granulated product having an average particle diameter of 2 mm with a roller compactor. Each of Components B to E was then crushed with a commercially available manner mill until the average particle diameter became 20 μm or less. Crushed Components B to E were thoroughly mixed collectively. Then, the mixture of Components B to E was coated on the surface of the internal nucleus with the granulated product of Component A as the internal nucleus by a centrifugal fluidizing type coating granulator in the same manner as in the preparation of Granulated Product 3-2. The obtained product was dried, thereby core/shell type spherical granules having an average particle size of 3 mm were obtained (one coating layer), which was designated Granulated Product 3-3.

Granulated Product 3-4:

Component A was granulated to an undefined granulated product having an average particle diameter of 2 mm with a roller compactor. Each of Components B to E was then crushed with a commercially available manner mill until the average particle diameter became 20 μm or less. Crushed Components C to E were thoroughly mixed collectively. Then, Component B was coated on the surface of the internal nucleus with the granulated product of Component A as the internal nucleus by a centrifugal fluidizing type coating granulator in the same manner as in the preparation of Granulated Product 3-2. In the next place, the mixture of Components C to E was coated on the coating layer of Component B with a centrifugal fluidizing type coating granulator. The obtained product was dried, thereby core/shell type spherical granules having an average particle size of 3 mm were obtained (two coating layers), which was designated Granulated Product 3-4.

Granulated Product 3-5:

Component A was granulated to an undefined granulated product having an average particle diameter of 2 mm with a roller compactor. Each of Components B to E was then crushed with a commercially available manner mill until the average particle diameter became 20 μm or less.

Then, Component B was coated on the surface of the internal nucleus with the granulated product of Component A as the internal nucleus by a centrifugal fluidizing type coating granulator in the same manner as in the preparation of Granulated Product 3-2. In the next place, Component C was coated on the coating layer of Component B with a centrifugal fluidizing type coating granulator. Then, Component D was coated on the coating layer of Component C by a centrifugal fluidizing type coating granulator in the same manner as above. Then, Component E was coated on the coating layer of Component D by a centrifugal fluidizing type coating granulator in the same manner as above. The obtained product was dried, thereby core/shell type spherical granules having an average particle size of 3 mm were obtained (four coating layers), which was designated Granulated Product 3-5.

Granulated Product 3-6:

Polyethylene glycol 6000 in an amount of 5 mass % of the entire mass of Granulated Product 3-5 was spray-coated on the surface of Granulated Product 3-5 by a fluidized bed granulating coating machine, the thus-obtained product was designated Granulated Product 3-6.

Each of Granulated Products 3-1 to 3-6 was taken in a beaker in an amount of 1 kg and allowed to stand in a room at 30° C. and relative humidity of 80% in open state for 10 days. Moisture absorption amount and the variation of form (solidifying property) were evaluated. The results obtained are shown in Table 3. Moreover, the critical relative humidities of the internal nucleus and the coating layer at 30° C. of each of Granulated Products 3-1 to 3-6 were measured and the results obtained are shown in Table 3.

TABLE 3

| Exp. No. | Granulated Product | Critical Relative Humidity of Internal Nucleus (%) | Critical Relative Humidity of 1st Coating Layer (%) | Critical Relative Humidity of 2nd Coating Layer (%) | Remarks | Moisture Absorption Rate (%) (absorption amount/mass of granules) | Variation of Form (solidifying property) |
|---|---|---|---|---|---|---|---|
| 1 | 3-1 | — | — | — | Comparison | 90 | granules liquefied |
| 2 | 3-2 | 98 | 95 | 50 | Comparison | 55 | excessive solidification, granular property and flow property was not restored even with high impact |
| 3 | 3-3 | 60 | 85 | — | Invention | 7 | light solidification, flow property was restored with slight impacts six times |
| 4 | 3-4 | 60 | 90 | 96 | Invention | 4 | light solidification, flow property was restored with slight impacts three times |
| 5 | 3-5 | 60 | 90 | 96 | Invention | 3 | light solidification, flow property was restored with slight impacts twice |
| 6 | 3-6 | 60 | 90 | 96 | Invention | 1 | did not solidify at all |

Note

The values of the critical relative humidity were the values of Granulated Products 1-1 to 1-6 respectively.

It can be seen from the results shown in Table 3 that in the prescription of containing thiosulfate, Granulated Products 3-3 to 3-6 which contained thiosulfate as the internal nucleus showed low moisture absorption and hardly solidified, thus satisfactory results could be obtained. In Granulated Product 3-1 which did not have core/shell structure, moisture absorption amount was high and granules liquefied with the lapse of time, thus this sample was impracticable. Granulated Product 3-2 was a core/shell type sample but moisture absorption amount was high and excessive solidification was seen because this sample did not contain thiosulfate in the internal nucleus but contained in the coating layer.

Further, among the samples according to the present invention, preferred results could be obtained in the case where the coating layer was comprised of 2 or more layers and the polymer was coated as the outermost layer.

Example 4

Development of color photographic paper was performed with the granulated processing agent according to the present invention.

(1) Photographic material used

The surface of a paper support laminated on both sides with polyethylene resin was corona discharged. The support was provided with a gelatin undercoat layer containing sodium dodecylbenzenesulfonate, and further, photographic constituting layers, from the first layer to the seventh layer, described below were coated in order to prepare a silver halide color photographic material Sample No. 001 shown below.

As the gelatin hardening agent in each layer, 1-oxy-3,5-dichloro-s-triazine sodium salt (HA-1) was used.

Further, Ab-1, Ab-2, Ab-3 and Ab-4 were added to each layer so that the total coating amount became 15.0 mg/m$^2$, 60.0 mg/m$^2$, 5.0 mg/m$^2$ and 10.0 mg/m$^2$, respectively.

(Ab-1) Preservative

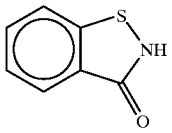

(Ab-2) Preservative

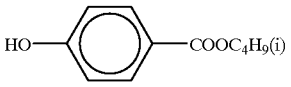

(Ab-3) Preservative

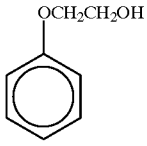

-continued (Ab-4) Preservative

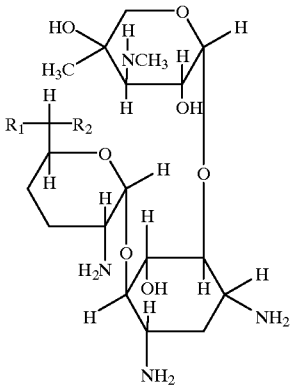

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

1/1/1/1 mixture of a/b/c/d (HA-1)

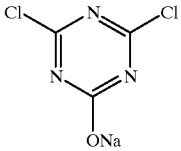

(HA-2)

$CH_2{=}CHSO_2CH_2SO_2CH{=}CH_2$

The spectral sensitizing dyes described below were usedin the silver chlorobromide emulsion of each light-sensitive emulsion layer.

Sensitizing Dyes for Blue-Sensitive Emulsion Layer:

Sensitizing Dye A

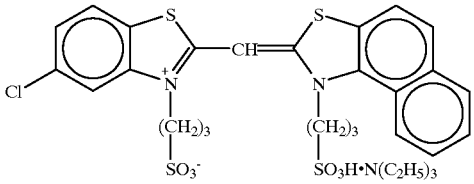

Sensitizing Dye B

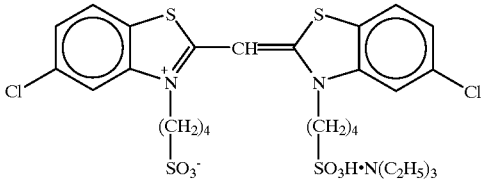

Sensitizing Dye C

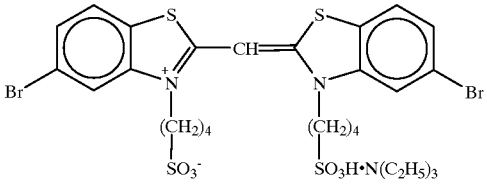

(each in an amount of $1.4\times10^{-4}$ mol per mol of the silver halide to the large grain size emulsion, and each in an amount of $1.7\times10^{-4}$ mol per mol of the silver halide to the small grain size emulsion)

Sensitizing Dyes for Green-Sensitive Emulsion Layer:

Sensitizing Dye D

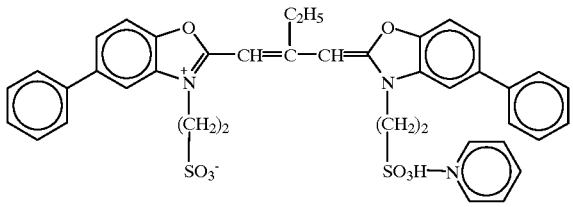

(in an amount of $3.0\times10^{-3}$ mol per mol of the silver halide to the large grain size emulsion and in an amount of $3.6\times10^{-4}$ mol per mol of the silver halide to the small grain size emulsion)

Sensitizing Dye E

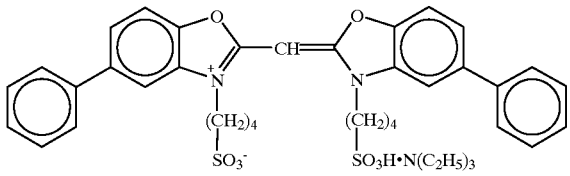

(in an amount of $4.0\times10^{-6}$ mol per mol of the silver halide to the large grain size emulsion and in an amount of $7.0\times10^{-5}$ mol per mol of the silver halide to the small grain size emulsion)

Sensitizing Dye F

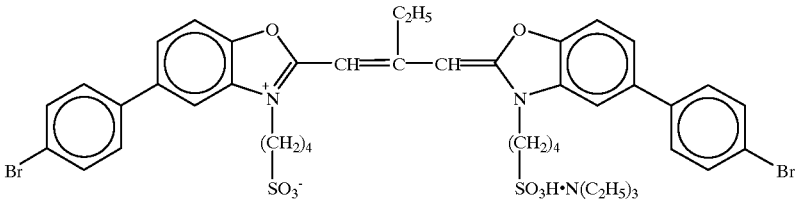

(in an amount of $2.0\times10^{-2}$ mol per mol of the silver halide to the large grain size emulsion and in an amount of $2.8\times10^{-4}$ mol per mol of the silver halide to the small grain size emulsion)

Sensitizing Dyes for Red-Sensitive Emulsion Layer:

Sensitizing Dye G

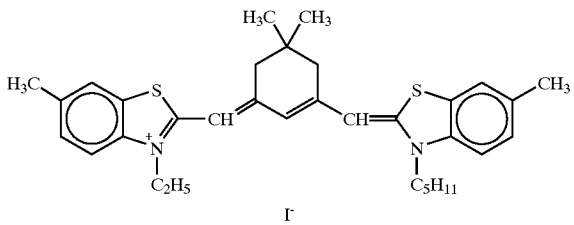

Sensitizing Dye H

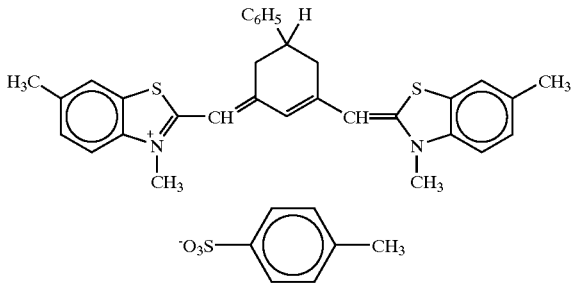

(each in an amount of $6.0\times10^{-5}$ mol per mol of the silver halide to the large grain size emulsion, and each in an amount of $9.0\times10^{-5}$ mol per mol of the silver halide to the small grain size emulsion)

Further, the following Compound I was added to the red-sensitive emulsion layer in an amount of $2.5\times10^{-3}$ mol per mol of the silver halide.

Compound I

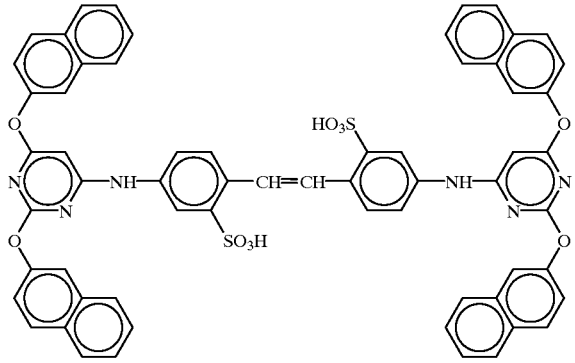

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide.

Further, 1-(3-methylureidophenyl)-5-mercaptotetrazole was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetra-azaindene was added to the blue-sensitive emulsion layer and the green-sensitive emulsion layer in an amount of $1\times10^{-4}$ mol and $2\times10^{-2}$ mol, respectively, per mol of the silver halide.

Copolymer of methacrylic acid and butyl acrylate (mass ratio: 1/1, average molecular weight: from 200,000 to 400,000) was added to the red-sensitive emulsion layer in an amount of 0.05 g/m$^2$.

Further, disodium catechol-3,5-disulfonate was added to the second layer, the fourth layer and the sixth layer in an amount of 6 mg/m$^2$, 6 mg/m$^2$ and 18 mg/m$^2$, respectively.

Moreover, the following dyes were added to the emulsion layers for preventing irradiation (the numerals in parentheses represent the coating amount).

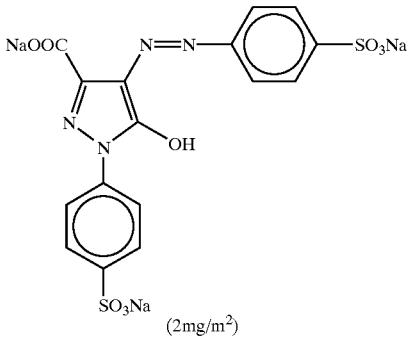

(2mg/m$^2$)

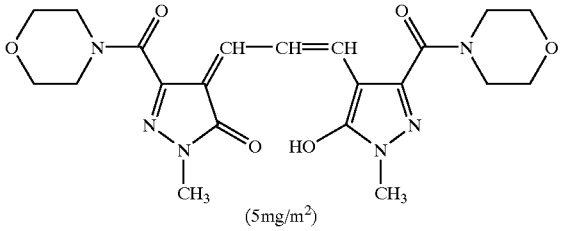

(5mg/m$^2$)

-continued

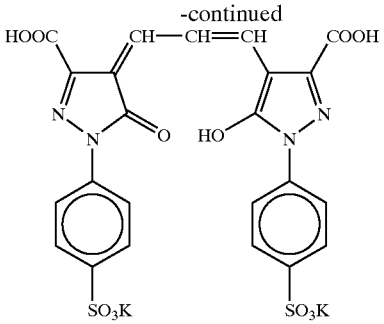

(1mg/m$^2$)

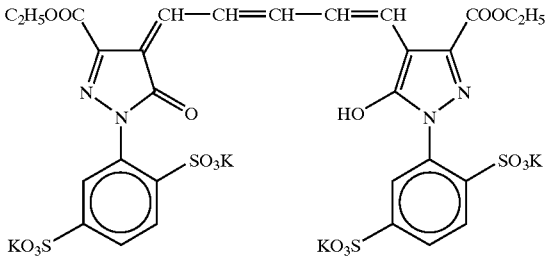

(10mg/m$^2$)

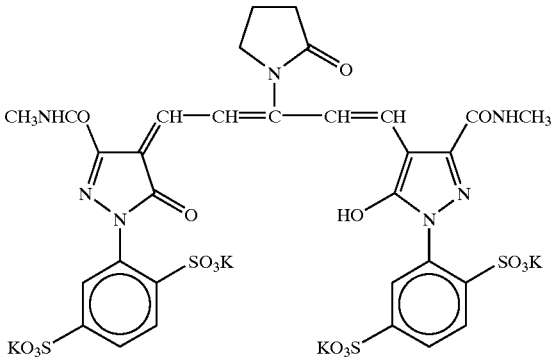

(10mg/m$^2$)

Layer Constitution

The constitution of each layer is described below. The numeral represents the coating amount (g/m$^2$). The numeral for silver halide emulsion represents the coating amount in terms of silver.

Support

Polyethylene resin-laminated paper (a white pigment ($TiO_2$, content: 16 mass %, ZnO, content: 4 mass %), a brightening agent (a mixture in a ratio of 8/2 of 4,4'-bis(benzoxazolyl)stilbene and 4,4'-bis(5-methylbenzoxazolyl) stilbene, content: 0.05 mass %), and a blue dye (ultramarine) were added to the polyethylene resin of the first layer side).

| | |
|---|---|
| First Layer (blue-sensitive emulsion layer) | |
| Silver Chlorobromide Emulsion (a cubic form, a mixture in a ratio of 3/7 (silver mol ratio) of large grain size emulsion A having an average grain size of 0.72 μm and small grain size emulsion A having an average grain size of 0.60 μm, variation coefficients of the grain size distribution were 0.08 and 0.10, respectively, both of them contained 0.3 mol% of silver bromide localized at a part of the grain surface and the remaining substrate being comprising silver chloride) | 0.25 |
| Gelatin | 1.35 |
| Yellow Coupler (ExY-1) | 0.41 |
| Yellow Coupler (ExY-2) | 0.21 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-8) | 0.04 |
| Solvent (Solv-1) | 0.23 |
| Second Layer (color mixture preventing layer) | |
| Gelatin | 1.00 |
| Color Mixing Preventive (Cpd-4) | 0.05 |
| Color Mixing Preventive (Cpd-5) | 0.07 |
| Color Image Stabilizer (Cpd-6) | 0.007 |
| Color Image Stabilizer (Cpd-7) | 0.14 |
| Color Image Stabilizer (Cpd-13) | 0.006 |
| Color Image Stabilizer (Cpd-21) | 0.01 |
| Solvent (Solv-1) | 0.06 |
| Solvent (Solv-2) | 0.22 |
| Third Layer (green-sensitive emulsion layer) | |
| Silver Chlorobromide Emulsion B (a cubic form, a mixture in a ratio of 1/3 (silver mol ratio) of large grain size emulsion B having an average grain size of 0.45 μm and small grain size emulsion B having an average grain size of 0.35 μm; variation coefficients of the grain size distribution were 0.10 and 0.08, respectively, both of them contained 0.4 mol% of silver bromide localized at a part of the grain surface, and the remaining substrate being comprising silver chloride) | 0.12 |
| Gelatin | 1.20 |
| Magenta Coupler (ExM-1) | 0.13 |
| Ultraviolet Absorber (UV-1) | 0.05 |
| Ultraviolet Absorber (UV-2) | 0.02 |
| Ultraviolet Absorber (UV-3) | 0.02 |
| Ultraviolet Absorber (UV-4) | 0.03 |
| Color Image Stabilizer (Cpd-2) | 0.01 |
| Color Image Stabilizer (Cpd-4) | 0.002 |
| Color Image Stabilizer (Cpd-7) | 0.08 |
| Color Image Stabilizer (Cpd-8) | 0.01 |
| Color Image Stabilizer (Cpd-9) | 0.03 |
| Color Image Stabilizer (Cpd-10) | 0.01 |
| Color Image Stabilizer (Cpd-11) | 0.0001 |
| Color Image Stabilizer (Cpd-13) | 0.004 |
| Solvent (Solv-3) | 0.10 |
| Solvent (Solv-4) | 0.19 |
| Solvent (Solv-5) | 0.17 |
| Fourth Layer (color mixture preventing layer) | |
| Gelatin | 0.71 |
| Color Mixing Preventive (Cpd-4) | 0.04 |
| Color Mixing Preventive (Cpd-5) | 0.05 |
| Color Image Stabilizer (Cpd-6) | 0.005 |
| Color Image Stabilizer (Cpd-7) | 0.10 |
| Color Image Stabilizer (Cpd-13) | 0.004 |
| Color Image Stabilizer (Cpd-21) | 0.01 |
| Solvent (Solv-1) | 0.04 |
| Solvent (Solv-2) | 0.16 |
| Fifth Layer (red-sensitive emulsion layer) | |
| Silver Chlorobromide Emulsion C (a cubic form, a mixture in a ratio of 1/4 (silver mol ratio) of large grain size emulsion C having an average grain size of 0.50 μm and small grain size emulsion C having an average grain size of 0.41 μm; variation coefficients of the grain size distribution were 0.09 and 0.11, respectively, both of them contained 0.8 mol% of silver bromide localized at a part of | 0.16 |

-continued

| | |
|---|---|
| the grain surface, and the remaining substrate being comprising silver chloride) | |
| Gelatin | 1.00 |
| Cyan Coupler (ExC-1) | 0.05 |
| Cyan Coupler (ExC-2) | 0.18 |
| Cyan Coupler (ExC-3) | 0.024 |
| Ultraviolet Absorber (UV-1) | 0.04 |
| Ultraviolet Absorber (UV-3) | 0.01 |
| Ultraviolet Absorber (UV-4) | 0.01 |
| Color Image Stabilizer (Cpd-1) | 0.23 |
| Color Image Stabilizer (Cpd-9) | 0.01 |
| Color Image Stabilizer (Cpd-12) | 0.01 |
| Color Image Stabilizer (Cpd-13) | 0.01 |
| Solvent (Solv-6) | 0.23 |
| Sixth Layer (ultraviolet absorbing layer) | |
| Gelatin | 0.46 |
| Ultraviolet Absorber (UV-1) | 0.14 |
| Ultraviolet Absorber (UV-2) | 0.05 |
| Ultraviolet Absorber (UV-3) | 0.05 |
| Ultraviolet Absorber (UV-4) | 0.04 |
| Ultraviolet Absorber (UV-5) | 0.03 |
| Ultraviolet Absorber (UV-6) | 0.04 |
| Solvent (Solv-7) | 0.18 |
| Seventh Layer (protective layer) | |
| Gelatin | 1.00 |
| Acryl-Modified Copolymer of Polyvinyl Alcohol (modification degree: 17%) | 0.04 |
| Liquid Paraffin | 0.02 |
| Surfactant (Cpd-14) | 0.01 |
| Surfactant (Cpd-15) | 0.01 |

The compounds used for preparing the composition of each layer described above are shown below.

(ExY-1) Yellow Coupler

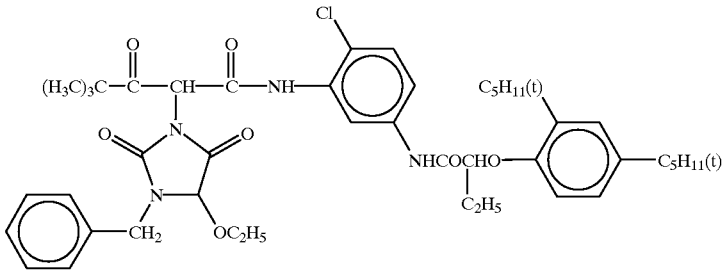

(ExY-2) Yellow Coupler

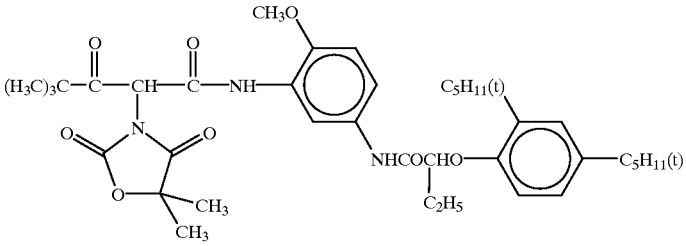

-continued
(ExM-1) Magenta Coupler
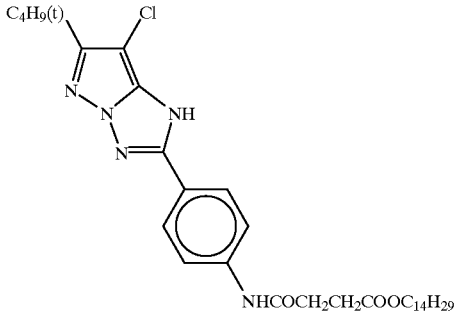
(ExC-1) Cyan Coupler
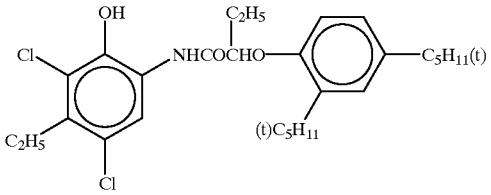
(ExC-2) Cyan Coupler
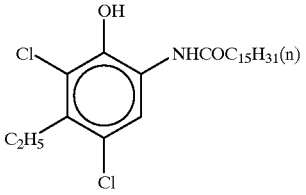
(ExC-3) Cyan Coupler
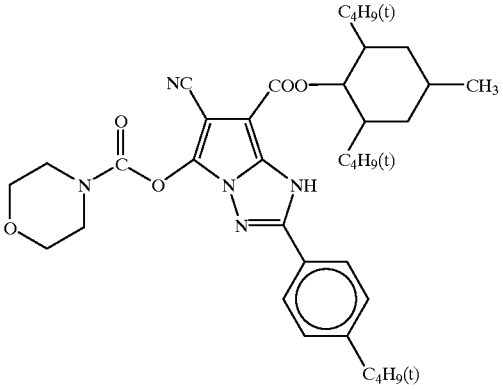
(Cpd-1) Color Image Stabilizer
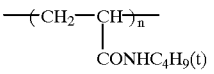
number average molecular weight: 60,000
(Cpd-2) Color Image Stabilizer
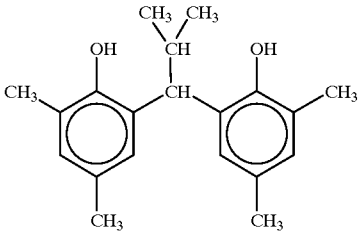

-continued
(Cpd-3) Color Image Stabilizer
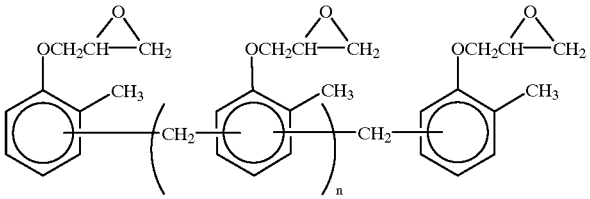
n = 7 to 8 (average value)
(Cpd-4) Color Mixing Preventive
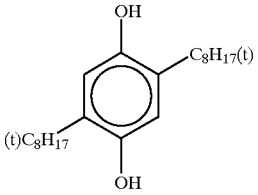
(Cpd-5) Color Mixing Preventive
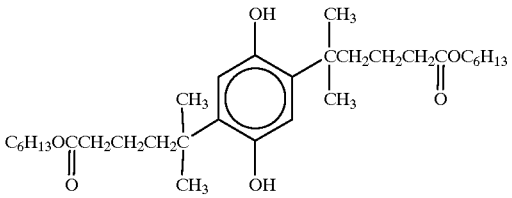
(Cpd-6) Color Mixing Preventive
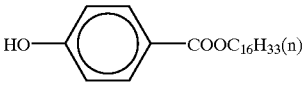
(Cpd-7) Color Image Stabilizer
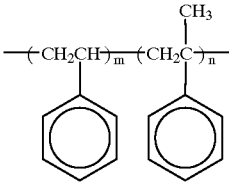
number average molecular weight; 600, m/n = 10/90
(Cpd-8) Color Image Stabilizer
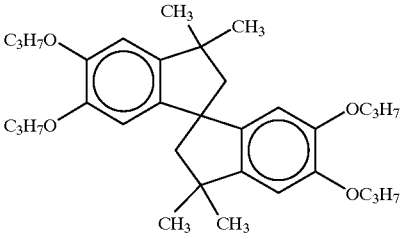

-continued
(Cpd-9) Color Image Stabilizer
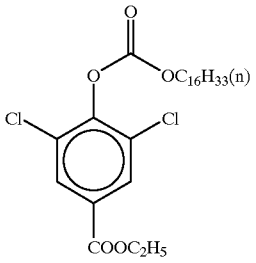
(Cpd-10) Color Image Stabilizer
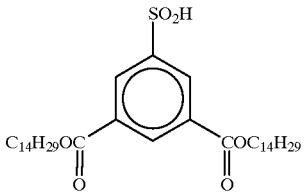
(Cpd-11) Color Image Stabilizer
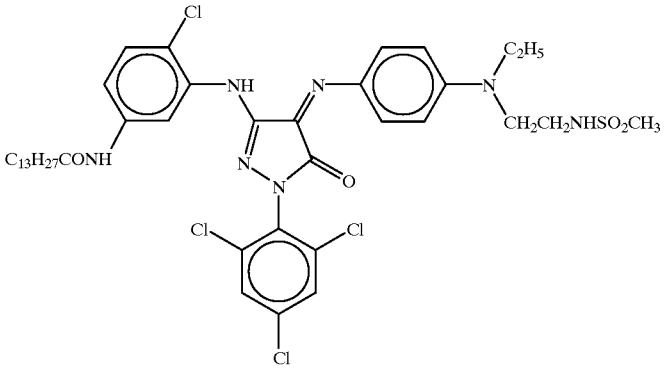
(Cpd-12) Color Image Stabilizer
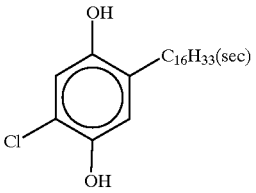
(Cpd-13) Color Image Stabilizer
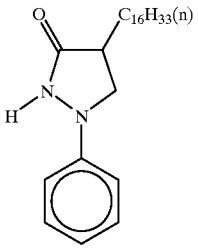

-continued
(Cpd-14) Surfactant
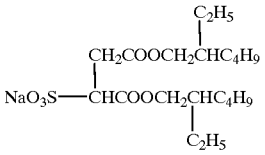
(Cpd-15) Surfactant
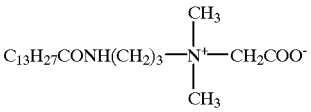
(Cpd-16)
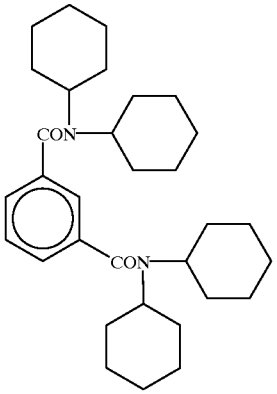
(Cpd-17)
1/1 mixture of
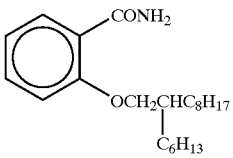
and
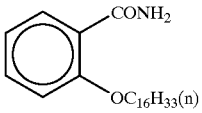
(Cpd-18)
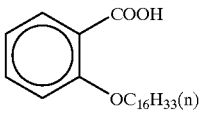
(Cpd-19)
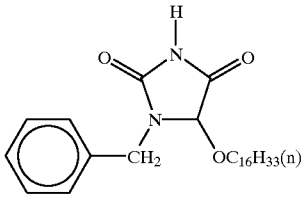

-continued
(Cpd-20)
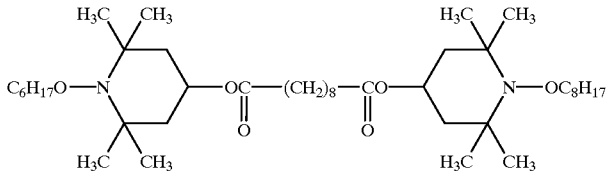
(Cpd-21) Color Image Stabilizer
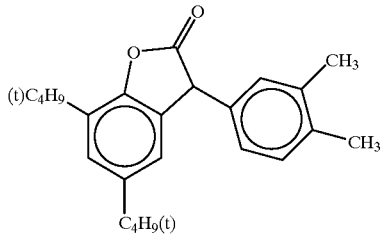
(UV-1) UV Absorber
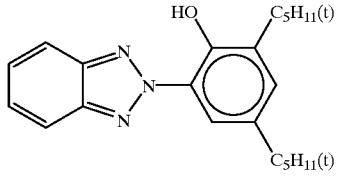
(UV-2) UV Absorber
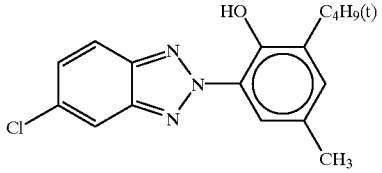
(UV-3) UV Absorber
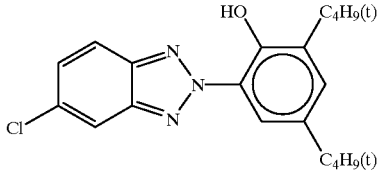
(UV-4) UV Absorber
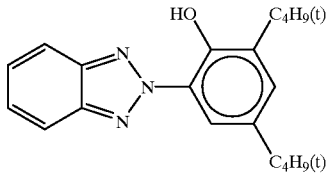
(UV-5) UV Absorber
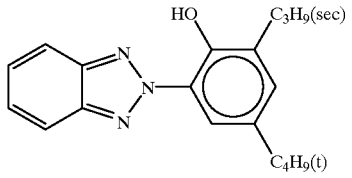

-continued
(UV-6) UV Absorber
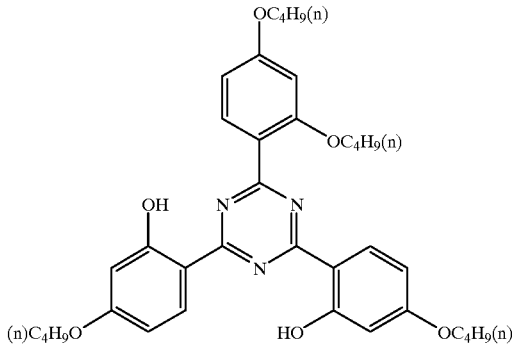
(Solv-1) Solvent
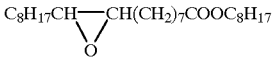
(Solv-2) Solvent
1/1 mixture by mol ratio of
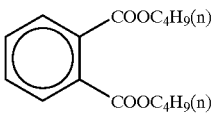
and
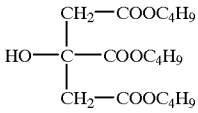
(Solv-3) Solvent
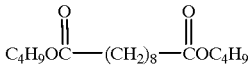
(Solv-4) Solvent
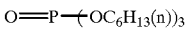
(Solv-5) Solvent
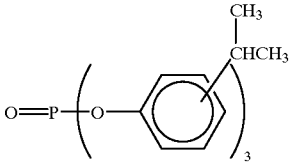

-continued (Solv-6) Solvent

1/1 mixture by mol ratio of

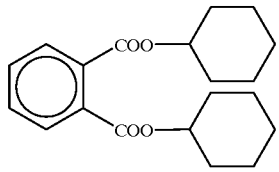

and

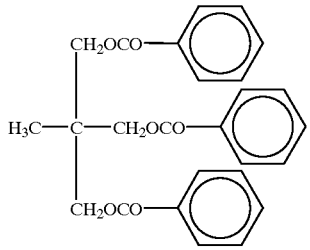

(Solv-7) Solvent

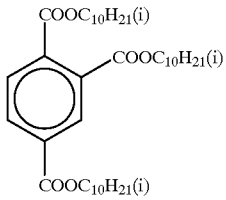

(2) Development process

Sample No. 001 was processed to a roll having 127 mm width, subjected to imagewise exposure by digital exposure system with mini-lab printer processor Frontier 350 (manufactured by Fuji Photo Film Co., Ltd.) and then to continuous processing (running test) according to the following processing step until the replenished amount of the color developing solution reached two times of the color developing tank capacity. Frontier 350 was modified such that the conveying speed was increased to 2.3 times, a rotary feeder system replenishing apparatus was provided more to supply granule replenisher directly to the processing tank, and a replenishing apparatus for adding water to the processing tank was provided more. A mixture of Granulated Products 1-6 and 1-7 (4/1 in mass) in Example 1 was used as the color developing replenisher, and Granulated Product 1-6 in Example 2 was used as the blixing replenisher.

| Processing Step | | | | |
|---|---|---|---|---|
| | | | Replenishing Rate* | |
| Step | Processing Temperature (° C.) | Processing Time (sec) | Granulated Agent (g) | Water (ml) |
| Color Development | 45 | 12 | 4 | 40 |
| Blixing | 40 | 12 | 7 | 28 |
| Rinsing (1)** | 40 | 4 | — | |
| Rinsing (2)** | 40 | 4 | — | |
| Rinsing (3)** | 40 | 4 | — | |

-continued

| Processing Step | | | | |
|---|---|---|---|---|
| | | | Replenishing Rate* | |
| Step | Processing Temperature (° C.) | Processing Time (sec) | Granulated Agent (g) | Water (ml) |
| Rinsing (4)** | 40 | 10 | — | 90 |
| Drying | 80 | 10 | | |

*Replenishment rate per $m^2$ of the photographic material

**Rinsing was conducted in a 4-tank countercurrent system from rinsing (4) to (1).

Rinse cleaning system RC 50 (manufactured by Fuji Photo Film Co., Ltd.) was used in rinsing system. The solution in tank (3) was removed, and the removed solution was supplied to reverse osmosis membrane module RC50by a pump. The permeated water obtained by this module was supplied to rinsing tank (4) and the concentrated solution was returned to rinsing tank (3). The pressure of the pump was controlled to maintain the permeation rate of the solution by this reverse osmosis membrane module of from 200 to 300 ml/min and was operated for 10 hours a day by controlling the temperature.

The composition of each processing solution used is described below.

| Color Developing Solution | |
|---|---|
| Cation Exchange Water | 800 ml |
| Dimethylpolysiloxane Surfactant (Silicone KF351A, manufactured by Shin-Etsu Chemical Co., Ltd.) | 0.1 g |
| Triisopropanolamine | 0.2 mol |
| Ethylenediaminetetraacetic Acid | 4.0 g |
| Potassium Chloride | 10.0 g |
| Potassium Bromide | 0.04 g |
| Sodium Sulfite | 0.1 g |
| Brightening Agent Hakkol FWA-SF (manufactured by Showa Kagaku Kogyo Co., Ltd.) | 4.0 g |
| Sodium p-toluenesulfonate | 20.0 g |
| Potassium Carbonate | 27.0 g |
| Disodium-N,N-bis(sulfonatoethyl)-hydroxylamine | 10.0 g |
| N-Ethyl-N-(β-methanesulfonamido-ethyl)-3-methyl-4-amino-aniline.3/2 Sulfate.Monohydrate | 10.0 g |
| Water to make | 1,000 ml |
| pH (25° C., adjusted with potassium hydroxide and sulfuric acid) | 10.30 |
| **Blixing Solution** | |
| Water | 600 ml |
| Ammonium Thiosulfate (750 g/liter) | 110 ml |
| Ammonium Sulfite | 40 g |
| Ammonium Ethylenediamine-tetraacetato Ferrate | 46 g |
| Ethylenediaminetetraacetic Acid | 5 g |
| Succinic Acid | 20 g |
| Water to make | 1,000 ml |
| pH (25° C., adjusted with nitric acid and aqueous ammonia) | 5.5 |
| **Rinsing Solution** | |
| Sodium Chlorinated Isocyanurate | 0.02 g |
| Deionized water (electric conductivity: 5 μs/cm or less) | 1,000 ml |
| pH | 6.5 |

Results of Development processing test

The replenishment of the granulated agent was satisfactorily performed without any-troubles throughout the period of running test.

Example 5

A granulated processing agent was prepared according to the following method using the constitutional compounds of a color developer shown below.

| Components constituting color developer | |
|---|---|
| **Component A:** | |
| Lithium hydroxide monohydrate | 620 g |
| **Component B:** | |
| Potassium carbonate | 1,200 g |
| **Component C:** | |
| Sodium sulfite | 10 g |
| **Component D:** | |
| Sodium p-toluenesulfonate | 910 g |
| **Component E:** | |
| Triazinyl aminostilbene-based brightening agent (Hakkol FWA-SF, manufactured by Showa Kagaku Kogyo Co., Ltd.) | 370 g |
| **Component F:** | |
| Disodium ethylenediaminetetraacetate | 230 g |
| **Component G:** | |
| Disodium-N,N-bis(sulfonatoethyl)hydroxylamine | 640 g |
| **Component H:** | |
| Disodium 4,5-dihydroxybenzene-1,2-disulfonate | 20 g |
| **Component I:** | |
| N-Ethyl-N-(β-methanesulfonamidoethyl)-3-methyl-4-amino-4-aminoaniline.3/2 sulfate. monohydrate | 1,000 g |

Granulation of granules

Granulated Product 5-1:

Components A to H were crushed with a commercially available manner mill until the average particle diameter became 20 μm or less, and crushed Components A to H were mixed and thoroughly kneaded. The mixture obtained was granulated to spherical granules having an average diameter of 3 mm with spraying water as a binder with an agitation granulator, and then the granules were dried, thereby Granulated Product 5-1 was obtained. Granulated Product 5-2:

Component D was granulated to an undefined granulated product having an average particle diameter of 1 mm with a roller compactor. Components A to C and E to H were then crushed with a commercially available manner mill until the average particle diameter became 20 μm or less. Crushed Components E, F, G and H were thoroughly mixed collectively. Crushed Components A, B and C were thoroughly mixed collectively as another mixture. Subsequently, the mixture of Components E, F, G and H was added on the surface of the internal nucleus with the granulated product of Component D as the internal nucleus while spraying water as a binder by a centrifugal fluidizing type coating granulator to thereby form a coating layer. Then, the mixture of Components A, B and C was coated on the coating layer of the mixture of Components E, F, G and H with a centrifugal fluidizing type coating granulator in the same manner as above. The obtained product was dried, thereby core/shell type spherical granules having an average particle size of 3 mm were obtained (two coating layers), which was designated Granulated Product 5-2.

Granulated Product 5-3:

Component A was granulated to an undefined granulated product having an average particle diameter of 1 mm with a roller compactor. Each of Components B to H was then crushed with a commercially available manner mill until the average particle diameter became 20 μm or less. Crushed Components B to H were thoroughly mixed collectively. Then, the mixture of Components B to H was coated on the surface of the internal nucleus with the granulated product of Component A as the internal nucleus by a centrifugal fluidizing type coating granulator in the same manner as in the preparation of Granulated Product 5-2. The coated granules were dried, thereby core/shell type spherical granules having an average particle size of 3 mm were obtained (one coating layer), which was designated Granulated Product 5-3.

Granulated Product 5-4:

Component A was granulated to an undefined granulated product having an average particle diameter of 1 mm with a roller compactor. Each of Components B to H was then crushed with a commercially available manner mill until the average particle diameter became 20 μm or less. Crushed Components C to H were thoroughly mixed collectively. Then, Component B was coated on the surface of the internal nucleus with the granulated product of Component A as the internal nucleus by a centrifugal fluidizing type coating granulator in the same manner as in the preparation of Granulated Product 5-2. In the next place, the mixture of Components C to H was coated on the coating layer of the mixture of Component B with a centrifugal fluidizing type coating granulator. The coated granules were dried, thereby core/shell type spherical granules having an average particle size of 3 mm were obtained (two coating layers), which was designated Granulated Product 5-4.

Granulated Product 5-5:

Component A was granulated to an undefined granulated product having an average particle diameter of 1 mm with a roller compactor. Each of Components B to H was then crushed with a commercially available manner mill until the average particle diameter became 20 μm or less. Crushed Components C and D and Components E, F, G and H were respectively thoroughly mixed. Then, Component B was coated on the surface of the internal nucleus with the granulated product of Component A as the internal nucleus by a centrifugal fluidizing type coating granulator in the same manner as in the preparation of Granulated Product 5-2. In the next place, the mixture of Components C and D was coated on the coating layer of Component B with a centrifugal fluidizing type coating granulator. Then, the mixture of Component E, F, G and G was coated on the coating layer of the mixture of Components C and D by a centrifugal fluidizing type coating granulator in the same manner as above. The coated granules were dried, thereby core/shell type spherical granules having an average particle size of 3 mm were obtained (three coating layers), which was designated Granulated Product 5-5.

Granulated Product 5-6:

Component A was granulated to an undefined granulated product having an average particle diameter of 1 mm with a roller compactor. Each of Components B to H was then crushed with a commercially available manner mill until the average particle diameter became 20 μm or less. Crushed Components C and D were thoroughly mixed collectively. Then, Component B was coated on the surface of the internal nucleus with the granulated product of Component A as the internal nucleus by a centrifugal fluidizing type coating granulator in the same manner. In the next place, the mixture of Components C and D was coated on the coating layer of Component B with a centrifugal fluidizing type coating granulator in the same manner as in the preparation of Granulated Product 5-2. Then, Component E was coated on the coating layer of the mixture of Components C and D by a centrifugal fluidizing type coating granulator in the same manner as above. Then, the mixture of Components F, G and H was coated on the coating layer of Component E by a centrifugal fluidizing type coating granulator in the same manner as above. The coated granules were dried, thereby core/shell type spherical granules having an average particle size of 3 mm were obtained (four coating layers), which was designated Granulated Product 5-6.

Granulated Product 5-7:

Component A was granulated to an undefined granulated product having an average particle diameter of 1 mm with a roller compactor. Each of Components B to H was then crushed with a commercially available manner mill until the average particle diameter became 20 μm or less. Crushed Components C and D and Components G and H were respectively thoroughly mixed. Then, Component B was coated on the surface of the internal nucleus with the granulated product of Component A as the internal nucleus by a centrifugal fluidizing type coating granulator in the same manner as in the preparation of Granulated Product 5-2. In the next place, the mixture of Components C and D was coated on the coating layer of Component B with a centrifugal fluidizing type coating granulator. Then, Component E was coated on the coating layer of the mixture of Components C and D by a centrifugal fluidizing type coating granulator in the same manner as above. Then, Component F was coated on the coating layer of Component E by a centrifugal fluidizing type coating granulator in the same manner as above. Then, the mixture of Components G and H was coated on the coating layer of Component F with a centrifugal fluidizing type coating granulator in the same manner as above. The coated granules were dried, thereby core/shell type spherical granules having an average particle size of 3 mm were obtained (five coating layers), which was designated Granulated Product 5-7.

Granulated Product 5-8:

Polyethylene glycol 6000 in an amount of 5 mass % of the entire mass of Granulated Product 5-5 was spray-coated on the surface of Granulated Product 5-7 by a fluidized bed granulating coating machine, the thus-obtained product was designated Granulated Product 5-8.

Granulated Product 5-9:

Component I was crushed with a commercially available manner mill until the average particle diameter became 20 μm or less, and crushed Component I was granulated to spherical granules having an average diameter of 3 mm with spraying water as a binder with an agitation granulator, and then the granules were dried, thereby Granulated Product 5-9 was obtained.

Each of Granulated Products 5-1 to 5-8 was mixed with Granulated Product 5-9 in mass ratio of 4/1, and 1 kg of each sample thus prepared was taken in a beaker and allowed to stand in a room at 30° C. and relative humidity of 80% in open state for 10 days. Moisture absorption amount and the variation of form (solidifying property) were evaluated. The results obtained are shown in Table 4. Morover, the critical relative humidities of the internal nucleus and the coating layer at 30° C. of each of Granulated Products 5-1 to 5-8 were measured and the results obtained are shown in Table 4. The measurement of moisture absorption amount was performed by weighing the mass, and shown in Table 4 in mass %.

With respect to Components G and H which are known to be liable to be oxidized by moisture absorption, the residual rates of Components G and H in respective granules were obtained by high performance liquid chromatography. The results obtained are shown in Table 4.

TABLE 4

| | Developer | | Moisture Absorption Rate | Residual Rate (%) | | |
|---|---|---|---|---|---|---|
| Exp. No. | Granulated Product | Number of Coating Layer | (mass %) (absorption amount/mass of granules) | Component G | Component H | Remarks |
| 1 | mixture of 5-1 and 5-9 | 0 | 80 | 41 | 10 | Comparison |
| 2 | mixture of 5-2 and 5-9 | 2 | 65 | 52 | 25 | Comparison |

TABLE 4-continued

| Exp. No. | Developer: Granulated Product | Developer: Number of Coating Layer | Moisture Absorption Rate (mass %) (absorption amount/mass of granules) | Residual Rate (%): Component G | Residual Rate (%): Component H | Remarks |
|---|---|---|---|---|---|---|
| 3 | mixture of 5-3 and 5-9 | 1 | 8 | 56 | 60 | Comparison |
| 4 | mixture of 5-4 and 5-9 | 2 | 5 | 62 | 65 | Comparison |
| 5 | mixture of 5-5 and 5-9 | 3 | 3 | 93 | 98 | Invention |
| 6 | mixture of 5-6 and 5-9 | 4 | 3 | 95 | 98 | Invention |
| 7 | mixture of 5-7 and 5-9 | 5 | 3 | 98 | 99 | Invention |
| 8 | mixture of 5-8 and 5-9 | 6 | 1 | 100 | 100 | Invention |

Note)
Coating layer number is layer number of each of Granulated Products 5-1 to 5-8 (Granulated Product 5-9 is developing agent granules).

It can be seen from the results shown in Table 4 that in the prescription of containing lithium hydroxide, Granulated Product 5-1 which did not have core/shell structure was high in moisture absorption amount and granules liquefied with the lapse of time, thus this sample was impracticable. Granulated Product 5-2 was a core/shell type sample but moisture absorption amount was high and the residual rates of Components G and H were low, this was because this sample did not contain lithium hydroxide in the internal nucleus but contained in the coating layer. Granulated Products 5-3 to 5-6 which contained lithium hydroxide as the internal nucleus showed low moisture absorption and Components G and H were stable, thus satisfactory results could be obtained. Granulated Products 5-5 to 5-8 comprised of three or more coating layers showed low hygroscopicity. Further, as a result of the test of allowing samples to stand under high humidity condition for 10 days, Granulated Products 5-5 to 5-8 comprised of three or more coating layers showed extremely high residual rates of Components G and H as compared with Granulated Products 5-1 to 5-4 (comparative samples) having two or less coating layers. Thus, remarkable protecting effect of the coating layer was confirmed.

Among the samples according to the present invention, in the case where the coating layer was comprised of three or more layers and, in addition, the polymer was coated as the outermost layer, it was confirmed that the effect of the present invention further increased.

Example 6

Granulated Products 5-10 to 5-14 were prepared in the same manner as the preparation of Granulated Product 5-8 except that the average particle size of the internal nuclei, the average particle size of the granules and the content of the granules having an average particle size of 0.5 mm or less were changed as shown in Table 5. Moisture absorption amount and the residual rates of Components G and H in respective granules were evaluated in the same manner as in Example 5, and the results obtained are shown in Table 5. The measured value of moisture absorption amount in Table 5 was also shown in mass %.

TABLE 5

| Exp. No. | Developer: Granulated Product | Developer: Average Particle Size of Internal Nuclei (mm) | Developer: Average Particle Size of Granules (mm) | Developer: Content of Granules Having Particle Diameter of 0.5 mm or less (mass %) | Moisture Absorption Rate (mass %) (absorption amount/mass of granules) | Residual Rate (%): Component G | Residual Rate (%): Component H | Remarks |
|---|---|---|---|---|---|---|---|---|
| 11 | mixture of 5-10 and 5-9 | 1 | 3 | 0 | 1 | 100 | 100 | Invention |
| 12 | mixture of 5-11 and 5-9 | 0.3 | 0.8 | 0 | 4 | 95 | 96 | Invention |
| 13 | mixture of 5-12 and 5-9 | 6.0 | 25 | 0 | 3 | 96 | 97 | Invention |
| 14 | mixture of 5-13 and 5-9 | 1 | 3 | 8 | 2 | 97 | 98 | Invention |
| 15 | mixture of 5-14 and 5-9 | 1 | 3 | 15 | 5 | 96 | 97 | Invention |

Note
Average particle size of internal nuclei, average particle size of granules, content of small size granules were those of Granulated Products 5-10 to 5-14.

Of the samples according to the present invention, when the average particle diameter of the internal nuclei was from 0.5 to 5 mm, when the average particle size of the granules was from 1 to 20 mm, and when the granules having particle diameter of 0.5 mm or less accounted for 10 mass % or less of the entire mass of the granules, moisture absorption amount was low and good results were obtained, and the residual rates of Components G and H were maintained at high level correspondingly.

Example 7

A granulated processing agent was prepared according to the following method using the constitutional compounds of a blixing agent shown below.

| Blixing component | |
|---|---|
| Component A: | |
| Mixture of ammonium thiosulfate and sodium thiosulfate (9/1 by mass ratio) | 2,000 g |
| Component B: | |
| Sodium sulfite | 1,100 g |
| Component C: | |
| Disodium ethylenediaminetetraacetate | 100 g |
| Component D: | |
| Ammonium ethylenediaminetetraacetato ferrate | 1,100 g |
| Component B: | |
| Succinic acid | 700 g |

Granulated Product 7-1:

Components A to E were crushed with a commercially available manner mill until the average particle diameter became 20 μm or less, and crushed Components A to E were mixed and thoroughly kneaded. The mixture obtained was granulated to spherical granules having an average diameter of 3 mm with spraying water as a binder with an agitation granulator, and then the granules were dried, thereby Granulated Product 7-1 was obtained.

Granulated Product 7-2:

Component D was granulated to an undefined granulated product having an average particle diameter of 1 mm with a roller compactor. Components A, B, C and E were then crushed with a commercially available manner mill until the average particle diameter became 20 μm or less. Crushed Components A and B were thoroughly mixed collectively. Crushed Components C and E were thoroughly mixed collectively as another mixture. Subsequently, the mixture of Components A and B was coated on the surface of the internal nucleus with the granulated product of Component D as the internal nucleus while spraying water as a binder by a centrifugal fluidizing type coating granulator to thereby form a coating layer. Then, the mixture of Components C and E was coated on the coating layer of the mixture of Components A and B with a centrifugal fluidizing type coating granulator in the same manner as above. The obtained product was dried, thereby core/shell type spherical granules having an average particle size of 3 mm were obtained (two coating layers), which was designated Granulated Product 7-2.

Granulated Product 7-3:

Component A was granulated to an undefined granulated product having an average particle diameter of 2 mm with a roller compactor. Each of Components B to E was then crushed with a commercially available manner mill until the average particle diameter became 20 μm or less. Crushed Components B to E were thoroughly mixed collectively. Then, the mixture of Components B to E was coated on the surface of the internal nucleus with the granulated product of Component A as the internal nucleus by a centrifugal fluidizing type coating granulator in the same manner as in the preparation of Granulated Product 7-2. The obtained product was dried, thereby core/shell type spherical granules having an average particle size of 3 mm were obtained (one coating layer), which was designated Granulated Product 7-3.

Granulated Product 7-4:

Component A was granulated to an undefined granulated product having an average particle diameter of 2 mm with a roller compactor. Each of Components B to E was then crushed with a commercially available manner mill until the average particle diameter became 20 μm or less. Crushed Components C to E were thoroughly mixed collectively. Then, Component B was coated on the surface of the internal nucleus with the granulated product of Component A as the internal nucleus by a centrifugal fluidizing type coating granulator in the same manner as in the preparation of Granulated Product 7-2. In the next place, the mixture of Components C to E was coated on the coating layer of Component B with a centrifugal fluidizing type coating granulator. The obtained product was dried, thereby core/shell type spherical granules having an average particle size of 3 mm were obtained (two coating layers), which was designated Granulated Product 7-4.

Granulated Product 7-5:

Component A was granulated to an undefined granulated product having an average particle diameter of 2 mm with a roller compactor. Each of Components B to E was then crushed with a commercially available manner mill until the average particle diameter became 20 μm or less. Crushed Components D and E were thoroughly mixed. Then, Component B was coated on the surface of the internal nucleus with the granulated product of Component A as the internal nucleus by a centrifugal fluidizing type coating granulator in the same manner as in the preparation of Granulated Product 7-2. In the next place, Component C was coated on the coating layer of Component B with a centrifugal fluidizing type coating granulator. Then, the mixture of Components D and E was coated on the coating layer of Component C by a centrifugal fluidizing type coating granulator in the same manner as above. The coated granules were dried, thereby core/shell type spherical granules having an average particle size of 3 mm were obtained (three coating layers), which was designated Granulated Product 7-5.

Granulated Product 7-6:

Component A was granulated to an undefined granulated product having an average particle diameter of 2 mm with a roller compactor. Each of Components B to E was then crushed with a commercially available manner mill until the average particle diameter became 20 μm or less. Then, Component B was coated on the surface of the internal nucleus with the granulated product of Component A as the internal nucleus by a centrifugal fluidizing type coating granulator in the same manner as in the preparation of Granulated Product 7-2. In the next place, Component C was coated on the coating layer of Component B with a centrifugal fluidizing type coating granulator. Then, Component D was coated on the coating layer of Component C by a centrifugal fluidizing type coating granulator in the same manner as above. Then, Component E was coated on the coating layer of Component D by a centrifugal fluidizing type coating granulator in the same manner as above. The coated granules were dried, thereby core/shell type spherical granules having an average particle size of 3 mm were obtained (four coating layers), which was designated Granulated Product 7-6.

Granulated Product 7-7:

Polyethylene glycol 6000 in an amount of 5 mass % of the entire mass of Granulated Product 7-6 was spray-coated on the surface of Granulated Product 7-6 by a fluidized bed granulating coating machine, the thus-obtained product was designated Granulated Product 7-7.

Each of Granulated Products 7-1 to 7-7 was taken in a beaker in an amount of 1 kg and allowed to stand in a room at 30° C. and relative humidity of 80% in open state for 10 days. Moisture absorption amount and the variation of the composition were evaluated. The results obtained are shown in Table 6. Moreover, moisture absorption amount was obtained by weighing the mass,and the results obtained are shown in Table 6. Further, the residual rates of Components G and H, which are liable to be oxidized by moisture absorption, in respective granules were obtained by high performance liquid chromatography. The results obtained are also shown in Table 6.

TABLE 6

| Developer | | | Moisture Absorption Rate | Residual Rate (%) | | |
|---|---|---|---|---|---|---|
| Exp. No. | Granulated Product | Number of Coating Layer | (mass %) (absorption amount/mass of granules) | Component A | Component B | Remarks |
| 1 | 7-1 | 0 | 90 | 61 | 10 | Comparison |
| 2 | 7-2 | 2 | 55 | 76 | 30 | Comparison |
| 3 | 7-3 | 1 | 7 | 78 | 44 | Comparison |
| 4 | 7-4 | 2 | 4 | 80 | 56 | Comparison |
| 5 | 7-5 | 3 | 3 | 99 | 96 | Invention |
| 6 | 7-6 | 4 | 3 | 99 | 98 | Invention |
| 7 | 7-7 | 5 | 1 | 100 | 100 | Invention |

It can be seen from the results shown in Table 6 that Granulated Product 7-1 which did not have core/shell structure was high in moisture absorption amount and granules liquefied with the lapse of time, thus this sample was impracticable. Granulated Product 7-2 was a core/shell type sample but moisture absorption amount was high and the residual rates of Components G and H were low, this was because this sample did not contain thiosulfate in the internal nucleus but contained in the coating layer. Granulated Products 7-3 and 7-4, in which the internal nuclei were coated with one or two coating layer(s), moisture absorption rate was improved but not so conspicuous. Contrary to this, Granulated Products 7-5 to 7-7 according to the present invention having three or more coating layers were markedly improved in moisture absorption rate, and the residual rate was maintained at such a high level as 96% or more. That is, when the coating layer was comprised of three or more layers and the polymer was coated as the outermost layer, moisture absorption rate was less and the effect of the present invention further increased.

Example 8

Development of color photographic paper was performed with the granulated processing agent according to the present invention.

(1) Photographic material used

The surface of a paper support laminated on both sides with polyethylene resin was corona discharged. The support was provided with a gelatin undercoat layer containing sodium dodecylbenzenesulfonate, and further, photographic constituting layers, from the first layer to the seventh layer, described below were coated in order to prepare a silver halide color photographic material Sample No. 001 shown below.

As the gelatin hardening agent in each layer, 1-oxy-3,5-dichloro-s-triazine sodium salt (HA-1) was used.

Further, Ab-1, Ab-2, Ab-3 and Ab-4 were added to each layer so that the total coating amount became 15.0 mg/m$^2$, 60.0 mg/m$^2$, 5.0 mg/m$^2$ and 10.0 mg/m$^2$, respectively.

(Ab-1) Preservative

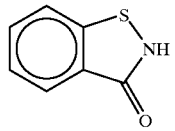

(Ab-2) Preservative

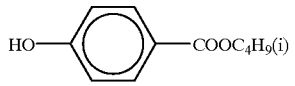

(Ab-3) Preservative

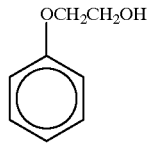

(Ab-4) Preservative

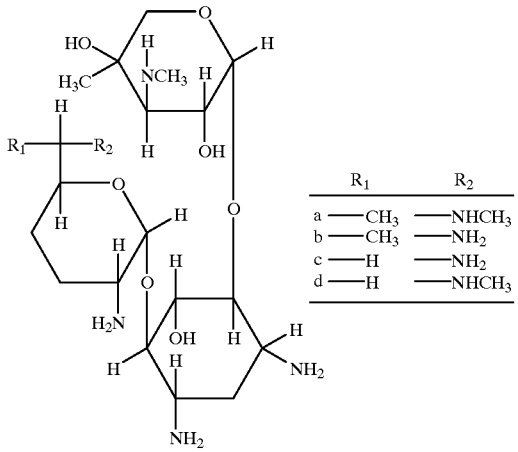

1/1/1/1 mixture of a/b/c/d (HA-1)

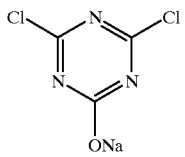

(HA-2)

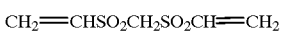

The spectral sensitizing dyes described below were used in the silver chlorobromide emulsion of each light-sensitive emulsion layer.

Sensitizing Dyes for Blue-Sensitive Emulsion Layer:

Sensitizing Dye A

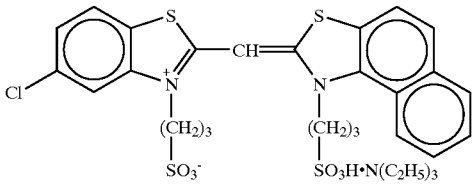

Sensitizing Dye B

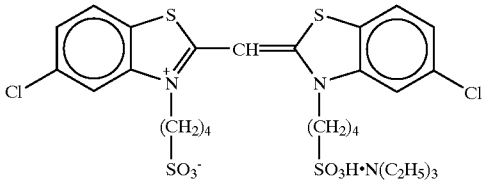

-continued

Sensitizing Dye C

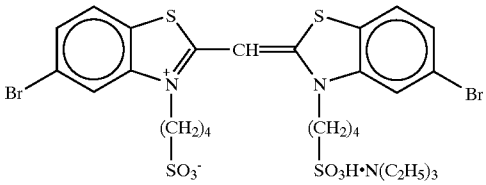

(each in an amount of $1.4\times10^{-4}$ mol per mol of the silver halide to the large grain size emulsion, and each in an amount of $1.7\times10^{-4}$ mol per mol of the silver halide to the small grain size emulsion)

Sensitizing Dyes for Green-Sensitive Emulsion Layer:

Sensitizing Dye D

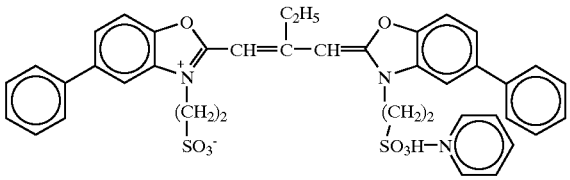

(in an amount of $3.0\times10^{-3}$ mol per mol of the silver halide to the large grain size emulsion and in an amount of $3.6\times10^{-4}$ mol per mol of the silver halide to the small grain size emulsion)

Sensitizing Dye E

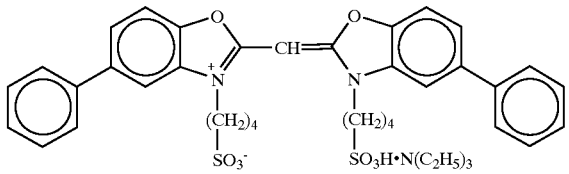

(in an amount of $4.0\times10^{-6}$ mol per mol of the silver halide to the large grain size emulsion and in an amount of $7.0\times10^{-5}$ mol per mol of the silver halide to the small grain size emulsion)

Sensitizing Dye F

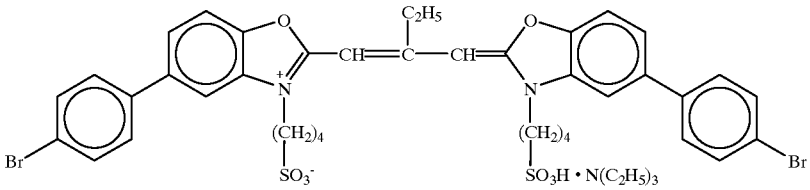

(in an amount of $2.0\times10^{-2}$ mol per mol of the silver halide to the large grain size emulsion and in an amount of $2.8\times10^{-4}$ mol per mol of the silver halide to the small grain size emulsion)

Sensitizing Dyes for Red-Sensitive Emulsion Layer:

Sensitizing Dye G

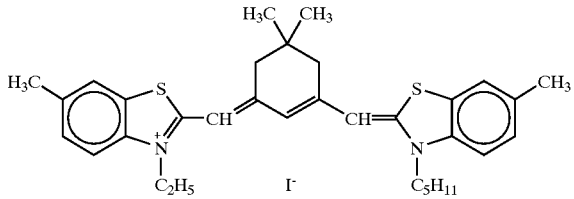

Sensitizing Dye H

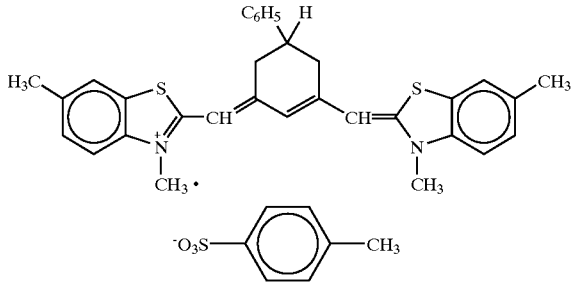

(each in an amount of $6.0\times10^{-5}$ mol per mol of the silver halide to the large grain size emulsion, and each in an amount of $9.0\times10^{-5}$ mol per mol of the silver halide to the small grain size emulsion)

Further, the following Compound I was added to the red-sensitive emulsion layer in an amount of $2.5\times10^{-3}$ mol per mol of the silver halide.

Compound I

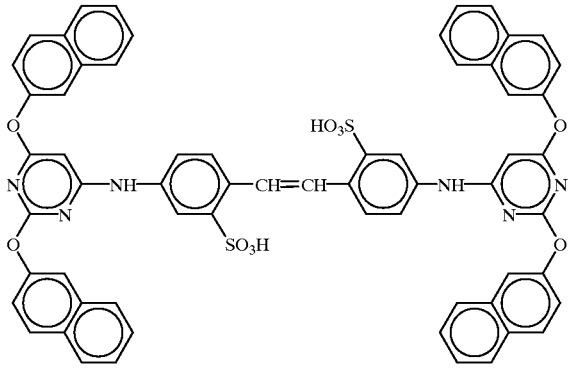

Further, 1-(3-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide.

Further, 1-(3-methylureidophenyl)-5-mercaptotetrazole was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetra-azaindene was added to the blue-sensitive emulsion layer and the green-sensitive emulsion layer in an amount of $1\times10^{-4}$ mol and $2\times10^{-2}$ mol, respectively, per mol of the silver halide.

Copolymer of methacrylic acid and butyl acrylate (mass ratio: 1/1, average molecular weight: from 200,000 to 400,000) was added to the red-sensitive emulsion layer in an amount of 0.05 g/m$^2$.

Further, disodium catechol-3,5-disulfonate was added to the second layer, the fourth layer and the sixth layer in an amount of 6 mg/m$^2$, 6 mg/m$^2$ and 18 mg/m$^2$, respectively.

Moreover, the following dyes were added to the emulsion layers for preventing irradiation (the numerals in parentheses represent the coating amount).

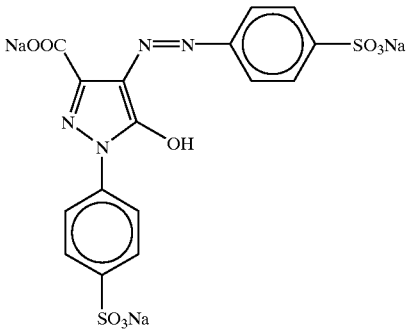

(2 mg/m$^2$)

-continued

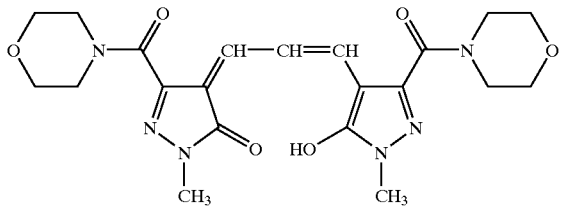

(5 mg/m$^2$)

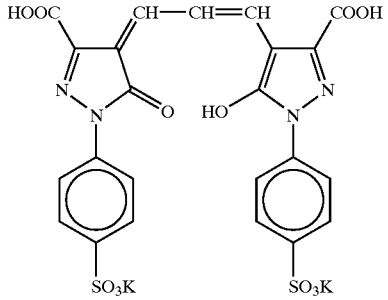

(1 mg/m$^2$)

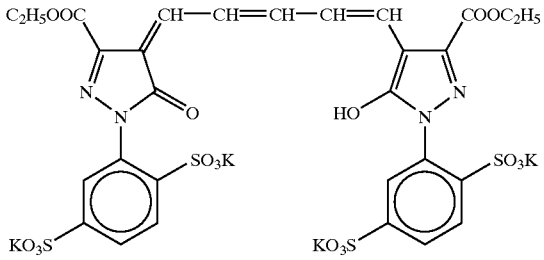

(10 mg/m$^2$)

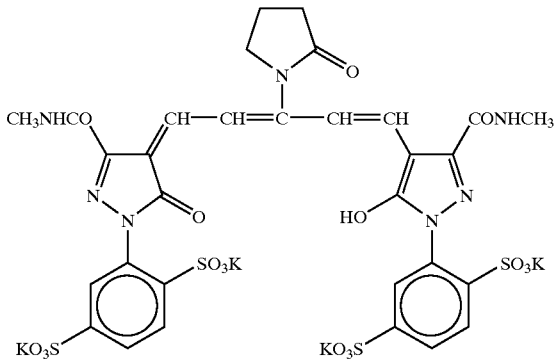

(10 mg/m$^2$)

Layer Constitution

The constitution of each layer is described below. The numeral represents the coating amount (g/m$^2$). The numeral for silver halide emulsion represents the coating amount in terms of silver.

Support

Polyethylene resin-laminated paper (a white pigment ($TiO_2$, content: 16 mass %, ZnO, content: 4 mass %), a brightening agent (a mixture in a ratio of 8/2 of 4,4'-bis(benzoxazolyl)stilbene and 4,4'-bis(5-methylbenzoxazolyl) stilbene, content: 0.05 mass %), and a blue dye (ultramarine) were added to the polyethylene resin of the first layer side).

| | |
|---|---|
| First Layer (blue-sensitive emulsion layer) | |
| Silver Chlorobromide Emulsion (a cubic form, a mixture in a ratio of 3/7 (silver mol ratio) of large grain size emulsion A having an average grain size of 0.72 μm and small grain size emulsion A having an average grain size of 0.60 μm, variation coefficients of the grain size distribution were 0.08 and 0.10, respectively, both of them contained 0.3 mol% of silver bromide localized at a part of the grain surface and the remaining substrate being comprising silver chloride) | 0.25 |
| Gelatin | 1.35 |
| Yellow Coupler (ExY-1) | 0.41 |
| Yellow Coupler (ExY-2) | 0.21 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-8) | 0.04 |
| Solvent (Solv-1) | 0.23 |
| Second Layer (color mixture preventing layer) | |
| Gelatin | 1.00 |
| Color Mixing Preventive (Cpd-4) | 0.05 |
| Color Mixing Preventive (Cpd-5) | 0.07 |
| Color Image Stabilizer (Cpd-6) | 0.007 |
| Color Image Stabilizer (Cpd-7) | 0.14 |
| Color Image Stabilizer (Cpd-13) | 0.006 |
| Color Image Stabilizer (Cpd-21) | 0.01 |
| Solvent (Solv-1) | 0.06 |
| Solvent (Solv-2) | 0.22 |
| Third Layer (green-sensitive emulsion layer) | |
| Silver Chlorobromide Emulsion B (a cubic form, a mixture in a ratio of 1/3 (silver mol ratio) of large grain size emulsion B having an average grain size of 0.45 μm and small grain size emulsion B having an average grain size of 0.35 μm; variation coefficients of the grain size distribution were 0.10 and 0.08, respectively, both of them contained 0.4 mol% of silver bromide localized at a part of the grain surface, and the remaining substrate being comprising silver chloride) | 0.12 |
| Gelatin | 1.20 |
| Magenta Coupler (ExM-1) | 0.13 |
| Ultraviolet Absorber (UV-1) | 0.05 |
| Ultraviolet Absorber (UV-2) | 0.02 |
| Ultraviolet Absorber (UV-3) | 0.02 |
| Ultraviolet Absorber (UV-4) | 0.03 |
| Color Image Stabilizer (Cpd-2) | 0.01 |
| Color Image Stabilizer (Cpd-4) | 0.002 |
| Color Image Stabilizer (Cpd-7) | 0.08 |
| Color Image Stabilizer (Cpd-8) | 0.01 |
| Color Image Stabilizer (Cpd-9) | 0.03 |
| Color Image Stabilizer (Cpd-10) | 0.01 |
| Color Image Stabilizer (Cpd-11) | 0.0001 |
| Color Image Stabilizer (Cpd-13) | 0.004 |
| Solvent (Solv-3) | 0.10 |
| Solvent (Solv-4) | 0.19 |
| Solvent (Solv-5) | 0.17 |
| Fourth Layer (color mixture preventing layer) | |
| Gelatin | 0.71 |
| Color Mixing Preventive (Cpd-4) | 0.04 |
| Color Mixing Preventive (Cpd-5) | 0.05 |
| Color Image Stabilizer (Cpd-6) | 0.005 |
| Color Image Stabilizer (Cpd-7) | 0.10 |
| Color Image Stabilizer (Cpd-13) | 0.004 |
| Color Image Stabilizer (Cpd-21) | 0.01 |
| Solvent (Solv-1) | 0.04 |
| Solvent (Solv-2) | 0.16 |
| Fifth Layer (red-sensitive emulsion layer) | |
| Silver Chlorobromide Emulsion C (a cubic form, a mixture in a ratio of 1/4 (silver mol ratio) of large grain size emulsion C having an average grain size of 0.50 μm and small grain size emulsion C having an average grain size of 0.41 μm; variation coefficients of the grain size distribution were 0.09 and 0.11, respectively, both of them contained 0.8 mol% of silver bromide localized at a part of | 0.16 |

-continued

| | |
|---|---|
| the grain surface, and the remaining substrate being comprising silver chloride) | |
| Gelatin | 1.00 |
| Cyan Coupler (ExC-1) | 0.05 |
| Cyan Coupler (ExC-2) | 0.18 |
| Cyan Coupler (ExC-3) | 0.024 |
| Ultraviolet Absorber (UV-1) | 0.04 |
| Ultraviolet Absorber (UV-3) | 0.01 |
| Ultraviolet Absorber (UV-4) | 0.01 |
| Color Image Stabilizer (Cpd-l) | 0.23 |
| Color Image Stabilizer (Cpd-9) | 0.01 |
| Color Image Stabilizer (Cpd-12) | 0.01 |
| Color Image Stabilizer (Cpd-13) | 0.01 |
| Solvent (Solv-6) | 0.23 |
| Sixth Layer (ultraviolet absorbing layer) | |
| Gelatin | 0.46 |
| Ultraviolet Absorber (UV-1) | 0.14 |
| Ultraviolet Absorber (UV-2) | 0.05 |
| Ultraviolet Absorber (UV-3) | 0.05 |
| Ultraviolet Absorber (UV-4) | 0.04 |
| Ultraviolet Absorber (UV-5) | 0.03 |
| Ultraviolet Absorber (UV-6) | 0.04 |
| Solvent (Solv-7) | 0.18 |
| Seventh Layer (protective layer) | |
| Gelatin | 1.00 |
| Acryl-Modified Copolymer of Polyvinyl Alcohol (modification degree: 17%) | 0.04 |
| Liquid Paraffin | 0.02 |
| Surfactant (Cpd-14) | 0.01 |
| Surfactant (Cpd-15) | 0.01 |

The compounds used for preparing the composition of each layer described above are shown below.

(ExY-1) Yellow Coupler

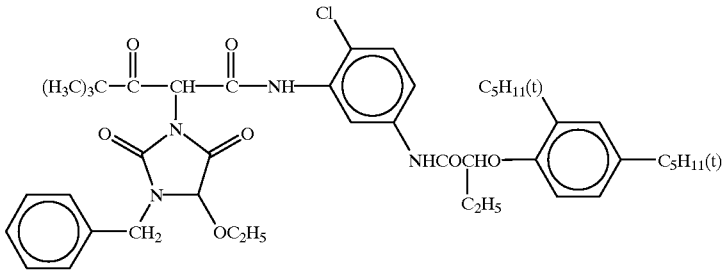

(ExY-2) Yellow Coupler

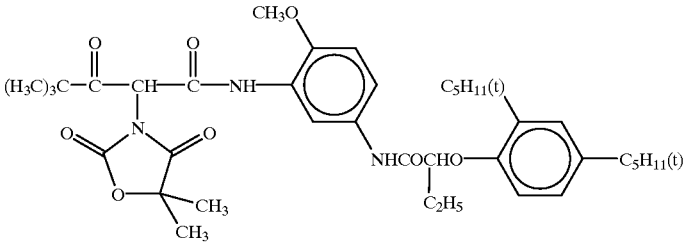

-continued
(ExM-1) Magenta Coupler
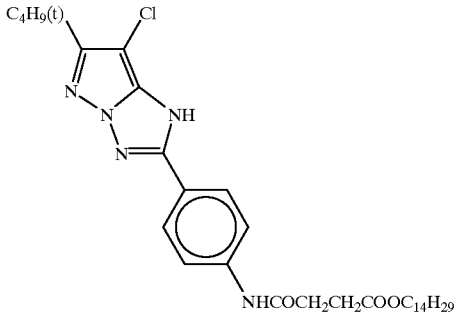
(ExC-1) Cyan Coupler
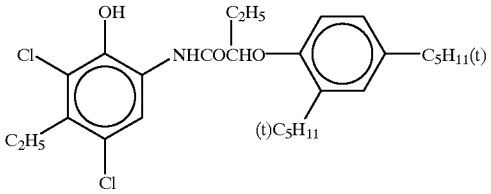
(ExC-2) Cyan Coupler
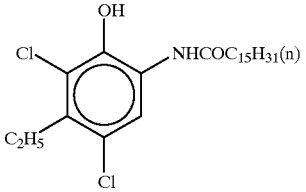
(ExC-3) Cyan Coupler
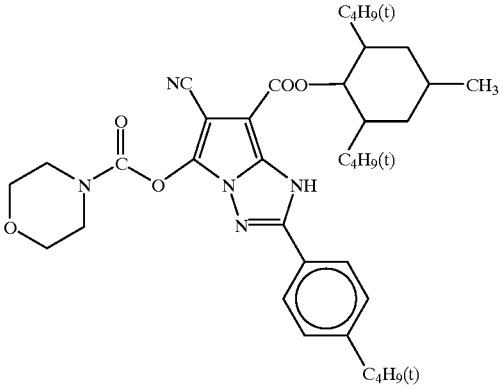
(Cpd-1) Color Image Stabilizer
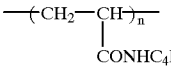
number average molecular weight: 60,000

-continued
(Cpd-2) Color Image Stabilizer
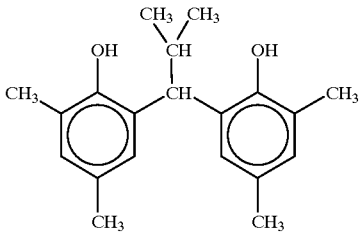
(Cpd-3) Color Image Stabilizer
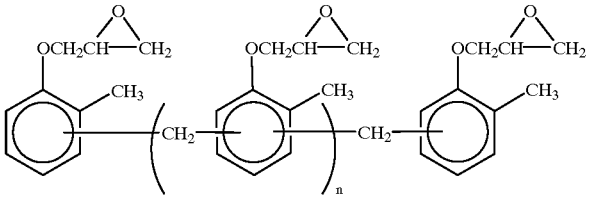
n = 7 to 8 (average value)
(Cpd-4) Color Mixing Preventive
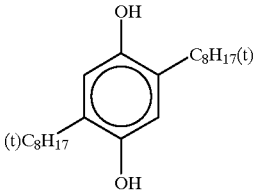
(Cpd-5) Color Mixing Preventive
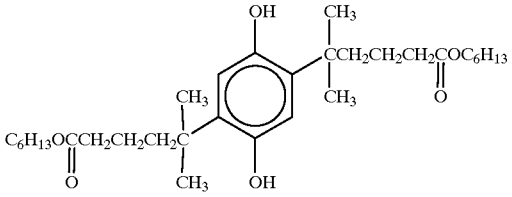
(Cpd-6) Color Mixing Preventive
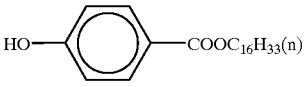
(Cpd-7) Color Image Stabilizer
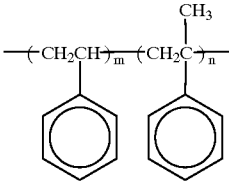
number average molecular weight; 600, m/n = 10/90

-continued
(Cpd-8) Color Image Stabilizer
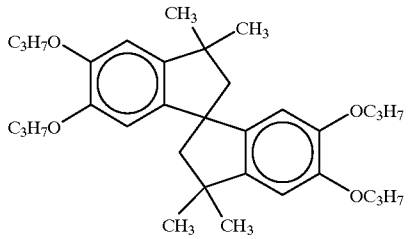
(Cpd-9) Color Image Stabilizer
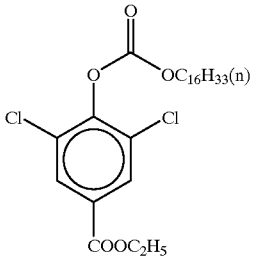
(Cpd-10) Color Image Stabilizer
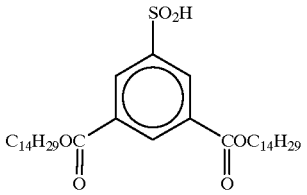
(Cpd-11) Color Image Stabilizer
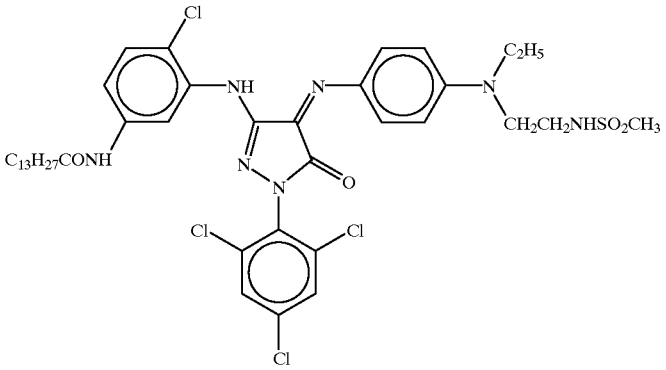
(Cpd-12) Color Image Stabilizer
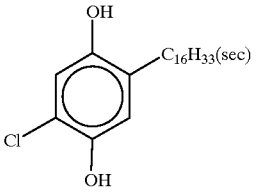

-continued
(Cpd-13) Color Image Stabilizer
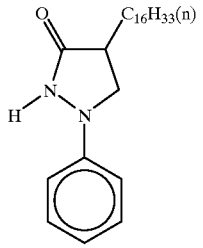
(Cpd-14) Surfactant
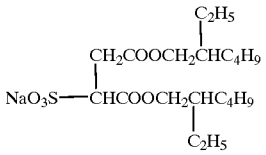
(Cpd-15) Surfactant
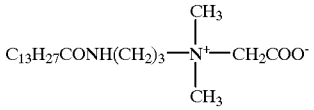
(Cpd-16)
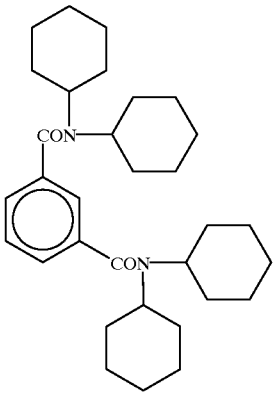
(Cpd-17)
1/1 mixture of
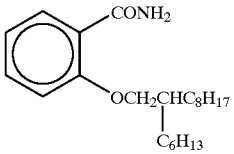
and
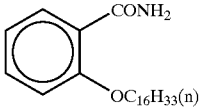
(Cpd-18)
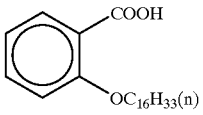

-continued
(Cpd-19)
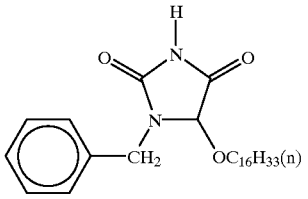
(Cpd-20)
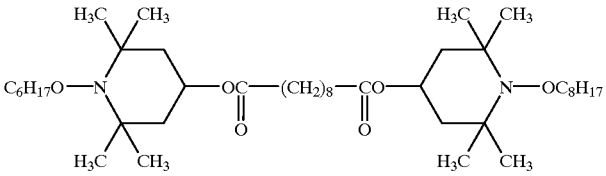
(Cpd-21) Color Image Stabilizer
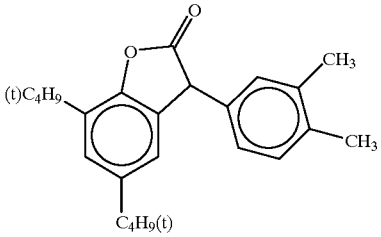
(UV-1) UV Absorber
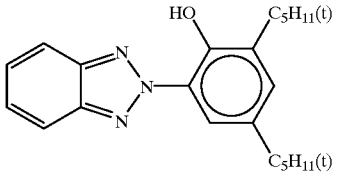
(UV-2) UV Absorber
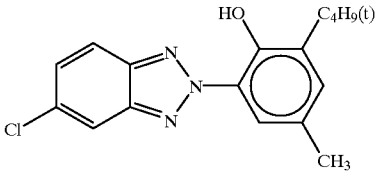
(UV-3) UV Absorber
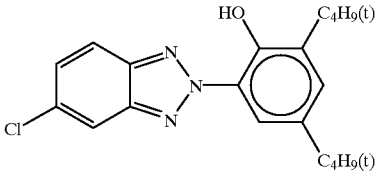
(UV-4) UV Absorber
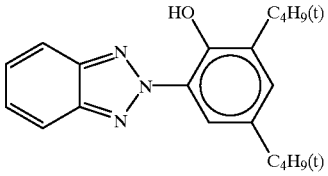

-continued
(UV-5) UV Absorber
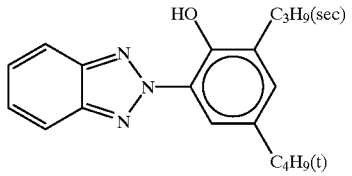
(UV-6) UV Absorber
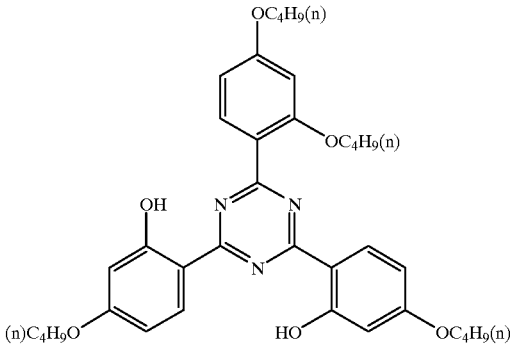
(Solv-1) Solvent
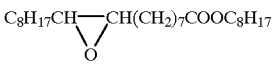
(Solv-2) Solvent
1/1 mixture by mol ratio of
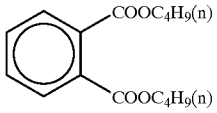
and
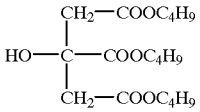
(Solv-3) Solvent
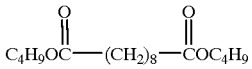
(Solv-4) Solvent
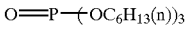
(Solv-5) Solvent
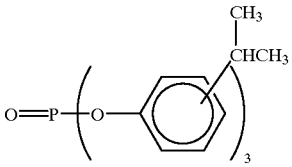

-continued (Solv-6) Solvent

1/1 mixture by mol ratio of

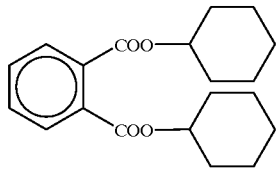

and

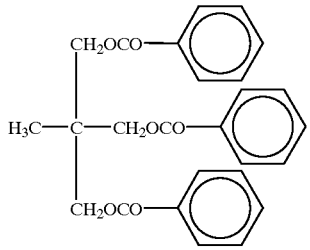

(Solv-7) Solvent

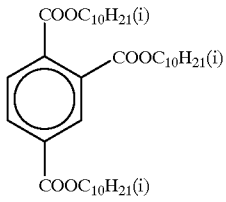

(2) Development process

Sample No. 001 was processed to a roll having 127 mm width, subjected to imagewise exposure by digital exposure system with mini-lab printer processor Frontier 350 (manufactured by Fuji Photo Film Co., Ltd.) and then to continuous processing (running test) according to the following processing step until the replenished amount of the color developing solution reached two times of the color developing tank capacity. Frontier 350 was modified such that the conveying speed was increased to 2.3 times, a rotary feeder system replenishing apparatus was provided more to supply granule replenisher directly to the processing tank, and a replenishing apparatus for adding water to the processing tank was provided more. A mixture of Granulated Products 5-8 and 5-7 (4/1 in mass) in Example 5 was used as the color developing replenisher, and Granulated Product 7-7 in Example 7 was used as the blixing replenisher.

| Processing Step | | | | |
|---|---|---|---|---|
| | | | Replenishing Rate* | |
| Step | Processing Temperature (° C.) | Processing Time (sec) | Granule Agent (g) | Water (ml) |
| Color Development | 45 | 12 | 4 | 40 |
| Blixing | 40 | 12 | 7 | 28 |
| Rinsing (1)** | 40 | 4 | — | |
| Rinsing (2)** | 40 | 4 | — | |

-continued

| Processing Step | | | | |
|---|---|---|---|---|
| | | | Replenishing Rate* | |
| Step | Processing Temperature (° C.) | Processing Time (sec) | Granule Agent (g) | Water (ml) |
| Rinsing (3)** | 40 | 4 | — | |
| Rinsing (4)** | 40 | 10 | — | 90 |
| Drying | 80 | 10 | | |

*Replenishment rate per $m^2$ of the photographic material

**Rinsing was conducted in a 4-tank countercurrent system from rinsing (4) to (1).

Rinse cleaning system RC 50 (manufactured by Fuji Photo Film Co., Ltd.) was used in rinsing system. The solution in tank (3) was removed, and the removed solution was supplied to reverse osmosis membrane module RC 50 by a pump. The permeated water obtained by this module was supplied to rinsing tank (4) and the concentrated solution was returned to rinsing tank (3). The pressure of the pump was controlled to maintain the permeation rate of the solution by this reverse osmosis membrane module of from 200 to 300 ml/min and was operated for 10 hours a day by controlling the temperature.

The composition of each processing solution used is described below.

| Color Developing Solution | |
|---|---|
| Cation Exchange Water | 800 ml |
| Dimethylpolysiloxane Surfactant (Silicone KF351A, manufactured by Shin-Etsu Chemical Co., Ltd.) | 0.1 g |
| Triisopropanolamine | 0.2 mol |
| Ethylenediaminetetraacetic Acid | 4.0 g |
| Potassium Chloride | 10.0 g |
| Potassium Bromide | 0.04 g |
| Sodium Sulfite | 0.1 g |
| Brightening Agent Hakkol FWA-SF (manufactured by Showa Kagaku Kogyo Co., Ltd.) | 4.0 g |
| Sodium p-toluenesulfonate | 20.0 g |
| Potassium Carbonate | 27.0 g |
| Disodium-N,N-bis(sulfonatoethyl)-hydroxylamine | 10.0 g |
| N-Ethyl-N-(β-methanesulfonamido-ethyl)-3-methyl-4-amino-aniline.3/2 SulfateMonohydrate | 10.0 g |
| Water to make | 1,000 ml |
| pH (25° C., adjusted with potassium hydroxide and sulfuric acid) | 10.30 |
| **Blixing Solution** | |
| Water | 600 ml |
| Ammonium Thiosulfate (750 g/liter) | 110 ml |
| Ammonium Sulfite | 40 g |
| Ammuonium Ethylenediamine-tetraacetato Ferrate | 46 g |
| Ethylenediaminetetraacetic Acid | 5 g |
| Succinic Acid | 20 g |
| Water to make | 1,000 ml |
| pH (25° C., adjusted with nitric acid and aqueous ammonia) | 5.5 |
| **Rinsing Solution** | |
| Sodium Chlorinated Isocyanurate | 0.02 g |
| Deionized water (electric conductivity: 5 μs/cm or less) | 1,000 ml |
| pH | 6.5 |

Results of Development processing test

The replenishment of the granulated agent was satisfactorily performed without any troubles throughout the period of running test.

The granulated processing agent according to the present invention constituted with an internal nucleus having the critical relative humidity of 70% or less and a coating layer having core/shell structure for covering the internal nucleus is excellent in storage stability, compact, moisture absorption during storage and handling is reduced, and the processing agent can be prevented from solidifying and adhering to each other. The processing agent according to the present invention can be directly added to an automatic processor to perform processing.

Further, the granulated processing agent according to the present invention having core/shell structure comprised of an internal nucleus and three or more coating layers for covering the internal nucleus is excellent in storage stability, compact, and moisture absorption during storage and handling is reduced. This processing agent can also be directly added to an automatic processor to perform processing.

While the invention has been described in detail and with reference to specific embodiments thereof, it will be apparent to one skilled in the art that various changes and modifications can be made therein without departing from the spirit and scope thereof.

This application is based on Japanese patent applications No. Hei-11-370354 filed on Dec. 27, 1999 and No. Hei-11-371043 filed on Dec. 27, 1999, the entire contents of which incorporated herein by reference.

What is claimed is:

1. A granulated solid processing agent for a silver halide photographic material, wherein the granule is a core/shell spherical granule comprising an internal nucleus and layer structure of three or more layers coating said internal nucleus, wherein the critical relative humidity of said internal nucleus is 70% or less, the internal nuclei have an average particle diameter of from 1 to 20 mm, and granules having a particle diameter of 0.5 mm or less account for 10 mass % or less based on the entire mass of the granulated solid processing agent.

2. The granulated solid processing agent for a silver halide photographic material as claimed in claim 1, wherein the critical relative humidity of the coating layer is higher than the critical relative humidity of said internal nucleus.

3. The granulated solid processing agent for a silver halide photographic material as claimed in claim 1, wherein said internal nucleus constituting the granule contains alkali metal hydroxide.

4. The granulated solid processing agent for a silver halide photographic material as claimed in claim 1, wherein said internal nucleus constituting the granule contains thiosulfate.

5. The granulated solid processing agent for a silver halide photographic material as claimed in claim 1, wherein the surface of the outermost layer of the granule is coated with a water-soluble polymer.

6. The granulated solid processing agent for a silver halide photographic material of claim 1, wherein said internal nucleus is composed of four or less compounds.

7. A method for producing a granulated solid processing agent for a silver halide photographic material, wherein the granule is a core/shell spherical granule comprising an internal nucleus and layer structure of three or more layers coating said internal nucleus, wherein the critical relative humidity of said internal nucleus is 70% or less, the internal nuclei have an average particle diameter of from 1 to 20 mm, and granules having a particle diameter of 0.5 mm or less account for 10 mass % or less based on the entire mass of the granulated solid processing agent, the method comprising the steps of granulating said internal nucleus having critical relative humidity of 70% or less, and then forming three or more coating layers on the surface of said internal nucleus.

* * * * *